United States Patent [19]

Sakamaki et al.

[11] Patent Number: 4,958,995

[45] Date of Patent: Sep. 25, 1990

[54] VANE PUMP WITH ANNULAR RECESSES TO CONTROL VANE EXTENSION

[75] Inventors: Hiroshi Sakamaki; Yukio Horikoshi; Takeshi Jinnouchi; Kenji Tanzawa, all of Sakado, Japan

[73] Assignee: Eagle Industry Co., Ltd., Tokyo, Japan

[21] Appl. No.: 197,548

[22] Filed: May 23, 1988

Related U.S. Application Data

[63] Continuation-in-part of Ser. No. 75,006, Jul. 17, 1987, abandoned, and a continuation-in-part of Ser. No. 110,919, Oct. 21, 1987, abandoned, and a continuation-in-part of Ser. No. 113,568, Oct. 26, 1987, abandoned, and a continuation-in-part of Ser. No. 115,677, Oct. 30, 1987, abandoned.

[30] Foreign Application Priority Data

| | | | |
|---|---|---|---|
| Jul. 22, 1986 | [JP] | Japan | 61-170903 |
| Jul. 22, 1986 | [JP] | Japan | 61-111490[U] |
| Oct. 23, 1986 | [JP] | Japan | 61-161610[U] |
| Oct. 23, 1986 | [JP] | Japan | 61-161609[U] |
| Nov. 4, 1986 | [JP] | Japan | 61-168147[U] |
| Nov. 4, 1986 | [JP] | Japan | 61-168145 |
| Nov. 14, 1986 | [JP] | Japan | 61-269961 |
| Nov. 14, 1986 | [JP] | Japan | 61-269960[U] |
| Nov. 17, 1986 | [JP] | Japan | 61-271934 |
| Nov. 21, 1986 | [JP] | Japan | 61-178288[U] |
| Nov. 21, 1986 | [JP] | Japan | 61-178287[U] |
| Nov. 21, 1986 | [JP] | Japan | 61-276689 |
| Nov. 21, 1986 | [JP] | Japan | 61-276690 |
| Dec. 3, 1986 | [JP] | Japan | 61-185571[U] |

[51] Int. Cl.[5] ..... F04C 2/344

[52] U.S. Cl. ..... 418/152; 418/257; 418/265

[58] Field of Search ..... 418/152, 257, 261, 264, 418/265

[56] References Cited

U.S. PATENT DOCUMENTS

| | | | |
|---|---|---|---|
| 1,444,269 | 2/1923 | Piatt | 418/257 |
| 1,669,779 | 5/1928 | Reavell | 418/265 |
| 2,672,282 | 3/1954 | Novas | 418/264 |
| 2,731,920 | 1/1956 | Scognamillo | 418/265 |
| 3,485,179 | 12/1969 | Dawes | 418/265 |

FOREIGN PATENT DOCUMENTS

| | | | |
|---|---|---|---|
| 30063 | 6/1933 | Netherlands | 418/265 |
| 410753 | 5/1934 | United Kingdom | 418/265 |

*Primary Examiner*—John J. Vrablik

*Attorney, Agent, or Firm*—Jordan and Hamburg

[57] ABSTRACT

A vane pump in which a projection is provided on the end of a vane which radially slides as a rotor rotates, and an annular race concentric with an inner peripheral surface of a housing is provided in the inner surface of the end wall of the housing, the projection being brought into engagement with the annular race to control the slide of the vane.

19 Claims, 34 Drawing Sheets

FIG. 21
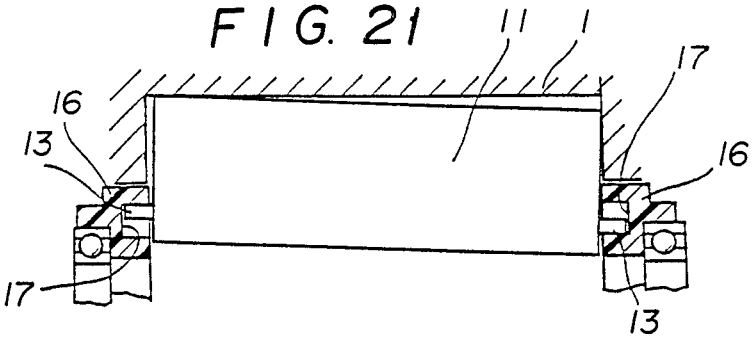
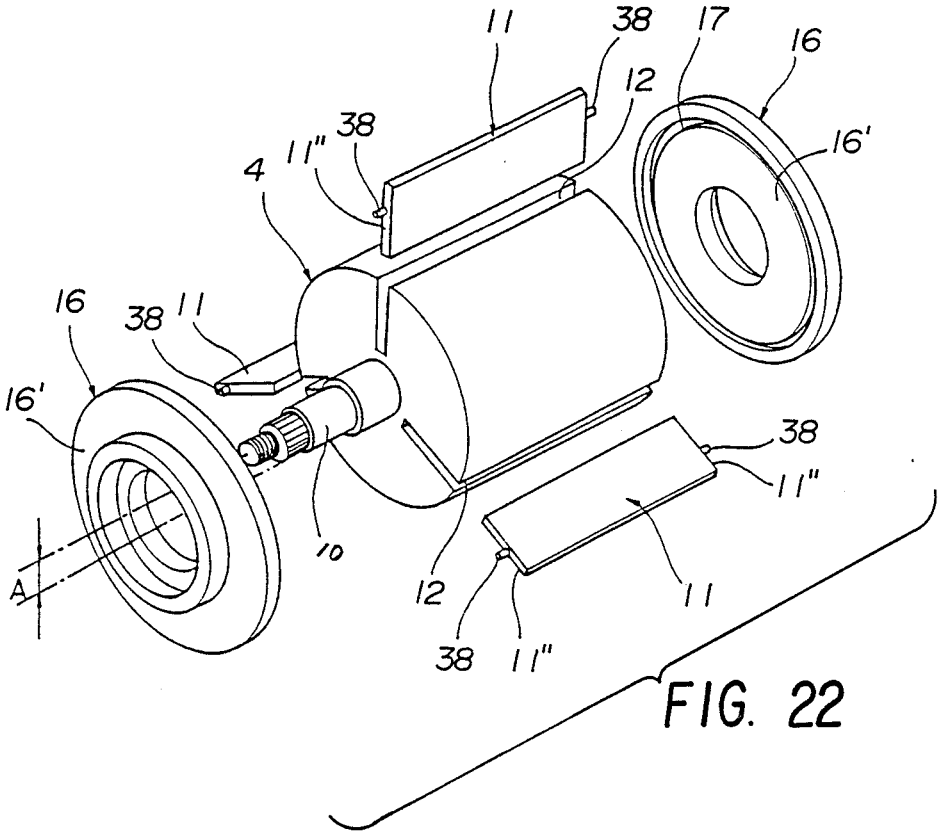
FIG. 22

VANE PUMP WITH ANNULAR RECESSES TO CONTROL VANE EXTENSION

RELATED APPLICATIONS

This is a Continuation-in-part application of U. S. Ser. No. 075,006 filed July 17, 1987; U. S. Ser. No. 110,919 filed Oct. 21, 1987; U. S. Ser. No. 113,568 filed Oct. 26, 1987; and U. S. Ser. No. 115,677 filed Oct. 30, 1987, all abandoned.

BACKGROUND OF THE INVENTION

The present invention relates to a vane pump which is one of rotary pumps used for various kinds of apparatuses such as a supercharger of an engine, a compressor of a freezing cycle, and the like.

A vane pump schematically shown in FIG. 38 has been heretofore widely known.

In FIG. 38, reference numeral 101 designates a housing; 102, a rotor inserted eccentrically into an inner peripheral space of the housing 101 and rotatably supported by a rotational shaft 103; 105*a*, 105*b* and 105*c*, plate-like vanes disposed radially retractably from vane grooves 104*a*, 104*b* and 104*c* equally spaced apart so as to peripherally divide the outer peripheral side of the rotor 102 into three sections. When the rotor 102 is rotated in the direction as indicated by the arrow X by the rotational shaft 103, the vanes 105*a*, 105*b* and 105*c* are moved out in the direction of the outside diameter by the centrifugal force, and the end edges thereof rotate while slidably contacting the inner peripheral surface of the housing 101. Since the rotor 102 is eccentric with respect to the housing 101 as previously mentioned, as such rotation occurs, volumes of working spaces 106*a*, 106*b* and 106*c* defined by the housing 101, the rotor 102 and the vanes 105*a*, 105*b* and 105*c* are repeatedly enlarged and contracted to allow a fluid taken in from an intake port 107 to be discharged out of an outlet port 108.

However, the above-described conventional vane pump has problems that since the vanes slidably move along the inner peripheral surface of the housing at high speeds, the efficiency of the volume caused by the great power loss due to the sliding resistance and by the generation of high sliding heat unavoidably deteriorates; the vanes materially become worn; and the vanes are expanded due to the generation of sliding heat to produce a galling with the inner side surfaces of both end walls of the housing, and the like.

In view of these problems as noted above, it is an object of the present invention to enhance the efficiency of such a pump and enhance the durability thereof.

SUMMARY OF THE INVENTION

To achieve the aforementioned objects, a vane pump according to the present invention is characterized in that projections such as pins are provided on both ends of a vane, and an annular race in peripheral slidable engagement with the projections to define the protrusion of the vane from a vane groove is formed coaxially with the inner peripheral surface of the housing.

According to the present invention, the protrusion of the vane from the vane groove is not defined by the contact thereof with the inner peripheral surface of the housing, but it is defined in a manner such that the end edge of the vane depicts a certain locus by the engagement of the projections such as pins provided on the vane with the annular race formed on the side of the housing. The vane may be rotated in the state in which the vane is not in contact with the inner surface of the housing, and therefore, the present invention has excellent advantages which can prevent the deterioration of the efficiency of the pump caused by the sliding resistance and the wear of the vane; and which can prevent occurrence of inconvenience resulting from an increase in sliding heat.

A vane pump according the present invention is also designed so that retainer plates are disposed coaxially with the inner peripheral surface of a housing and rotatably internally of both end walls of the housing, and protrusion of a vane resulting from rotation is defined by stoppers projectingly provided on the ends in the outer periphery of both retainer plates.

According to the present invention, the vane which protrudes out of a vane groove by a centrifugal force resulting from rotation rotates in a state not in contact with the housing since both axial side ends at the end edges of the vane come into contact with stoppers. Since the retainer plates rotate along with the rotor and the vane, the relative sliding between the vane and the stoppers can be minimized.

As described above, in the vane pump of the present invention, protrusion of the vane is defined by the stoppers at the ends in the outer periphery of the retainer plates rotatably provided internally of both the end walls of the housing, and the vane is rotated in a state not in contact with the housing. Therefore, it is possible to minimize lowering of the pump efficiency due to sliding resistance and high heat generation caused by sliding and the advance of wear and to lower the temperature of fluids discharged from the pump.

The present invention further provides a vane pump comprising a rotor rotatably supported in eccentric fashion in an inner peripheral space of a housing, and plate-like vanes disposed capable of being projected and retracted into a plurality of vane grooves in the form of a depression in the rotor, wherein repeated variations in volumes of working spaces between the vanes are utilized to suck a fluid from one side and discharge it toward the other, characterized in that retainer plates coaxial with the inner peripheral spaces are rotatably fitted internally of the end wall of the housing, and the vanes and retainer plates are connected by cams to define the protrusion of the vanes from the vane grooves.

According to the present invention, the protrusion of the vanes from the vane grooves is not defined by the contact with the inner peripheral surface of the housing but it is defined so that the end edges of the vanes depict a given locus by engagement of the retainer plates fitted in the housing with the vanes through the cams. The vanes can be rotated in a state not in contact with the inner surface of the housing. Therefore, the present invention has excellent effects in that the lowering of the rotational efficiency and the wear of the vanes due to the sliding resistance can be prevented, and the occurrence of inconvenience such as the lowering of the volume efficiency due to the increase in heat generation caused by sliding can also be prevented.

The present invention further provides a vane pump comprising a rotor rotatably supported in eccentric fashion in an inner peripheral space of a housing, and plate-like vanes disposed capable of being projected and retracted into a plurality of vane grooves in the form of depressions in the rotor, wherein repeated variations in volumes of working spaces between the vanes resulting from rotations of the rotor and the vanes are utilized to suck a fluid from one side and discharge it toward the other, characterized in that retainers or bearings coaxial with the inner peripheral spaces are rotatably disposed internally of the end wall of the housing, and the retainers or bearings are engaged with the vanes to define the protrusion of the vanes from the vane grooves, and a back pressure regulating groove is guided to a bottom of the vane groove positioned in the back surface of each of the vanes.

According to this aspect of the present invention, the protrusion of the vanes from the vane grooves is not defined by the contact thereof with the inner peripheral surface of the housing but is defined so that the end edge of the vanes depicts a fixed locus by the engagement of the retainer fitted in the housing and each of the vanes. Therefore, the vanes may be rotated in the state where they are not in contact with the inner surface of the housing; and when the vanes are operated to be projected and retracted, pressure of the bottom of the vane groove positioned in the back surface of the vane is made adjustable so as not to apply an excessive load to the vanes being projected and retracted.

Thereby, the vane pump according to this aspect of the present invention is designed so that the vanes may be rotated in a state not in contact with the inner peripheral surface of the housing, and therefore, the lowering of the rotational efficiency and the wear of vanes resulting from the sliding resistance may be prevented, and the occurrence of the lowering of the volumetric efficiency due to the increase of heat generation caused by sliding may be prevented; and the back pressure regulating groove is formed relative to the vane groove bottom so that the back pressure of the groove bottom may be regulated, and therefore the vanes may be operated smoothly without applying an excessive load thereto, and the smooth operation of the whole pump may be secured.

While the present invention has been briefly outlined, the above and other objects and new features of the present invention will be fully understood from the reading of the ensuing detailed description in conjunction with embodiments shown in the accompanying drawings. It is to be noted that the drawings are exclusively used to show certain embodiments for the understanding of the present invention and are not intended to limit the scope of this invention.

BRIEF DESCRIPTION OF THE DRAWINGS

FIG. 21 is an explanatory view showing the operating state of the vane pumps shown in FIGS. 1 to 3;

FIG. 22 is an exploded perspective view of essential parts of a vane pump belonging to Type 4;

DESCRIPTION OF THE PREFERRED EMBODIMENTS

Exemplification (I)

A fundamental exemplification of a vane pump according to the present invention will now be described with reference to FIGS. 1 to 3.

Figure 1:
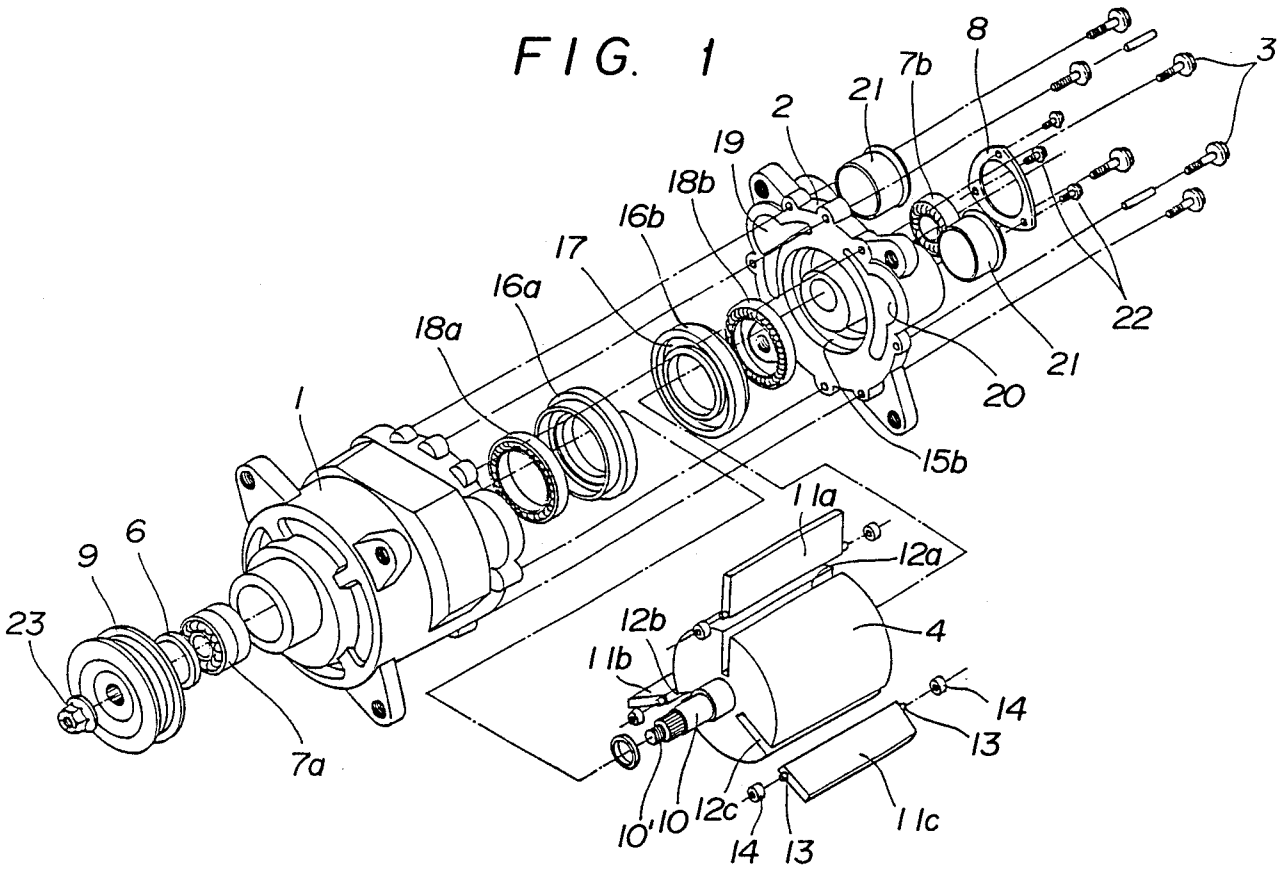
FIG. 1 is an exploded perspective view of a vane pump according to a fundamental embodiment of the present invention.
Figure 2:
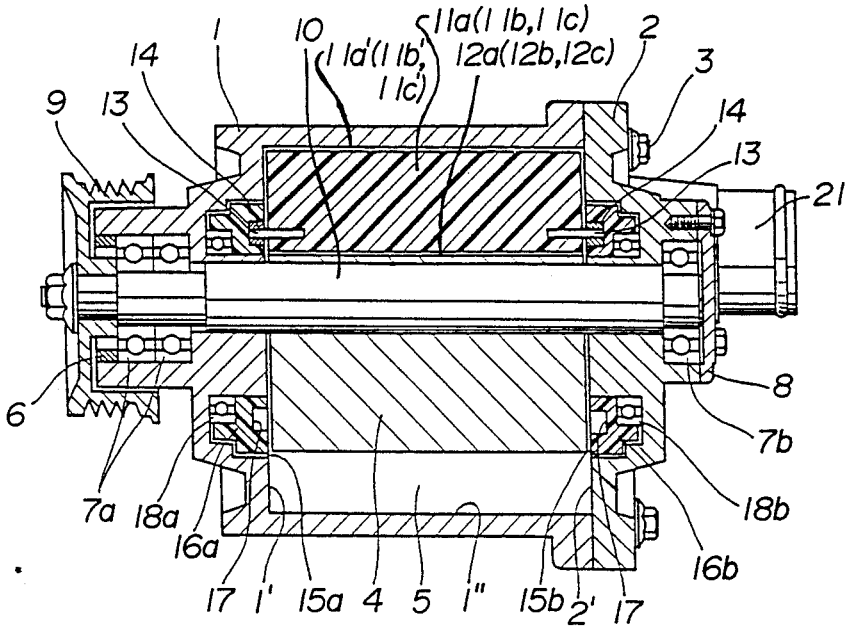
FIG. 2 is a sectional view showing the pump of FIG. 1 assembled.

In FIGS. 1 and 2, a front housing 1 and a rear housing 2, both of which housings are made of non-ferrous metal such as aluminum, which is light in weight and is small in the coefficient of thermal expansion, are secured integral with each other by means of bolts 3. A rotor 4 made of iron eccentrically inserted into an inner peripheral space 5 of the housing is extended through both the housings 1 and 2 through a ball bearing 7*a* held by a fixed ring 6 in anti-slipout fashion in an axial shoulder of the front housing 1 and a ball bearing 7*b* held by a bearing cover 8 in anti-slipout fashion in an axial shoulder of the rear housing 2 and is rotatably mounted on a rotational shaft 10 to which a drive force is transmitted from a pulley 9. Plate-like vanes 11*a*, 11*b* and 11*c* principally made of a carbon material having an excellent slidability are disposed to be radially projected and retracted in vane grooves 12*a*, 12*b* and 12c, respectively, which are formed in the form of depressions equally spaced apart so as peripherally divide the outer peripheral side of the rotor 4 into three sections, on the rotor 4. On opposite ends of each of the vanes 11*a*, 11*b* and 11*c* corresponding to axial opposite sides of the rotor 4 are projected steel pins 13 and 13, respectively, and a sleeve bearing 14 made of resin having excellent slidability and abrasion resistance is slipped over each of pins 13. In annular recesses 15*a* and 15*b* formed in inner surfaces 1′ and 2′ of end walls where the front housing 1 and the rear housing 2 are opposed to each other coaxial with the inner peripheral space 5 of the housing (coaxial with the inner peripheral surface 1″ of the front housing 1), retainer rings 16*a* and 16*b* made of non-ferrous metal such as aluminum and each having an annular race 17 are rotatably fitted through ball bearings 18*a* and 18*b*, respectively. The pins 13 and 13 projected on the respective vanes 11*a*, 11*b* and 11*c* peripherally slidably engage the annular races 17 and 17 of the retainer rings 16*a* and 16*b* through the respective sleeve bearings 14. This engagement defines the radial movement of the vanes 11*a*, 11*b* and 11*c* during rotation so as to maintain a state in which there is formed a slight clearance between the end edges 11*a*′, 11*b*′ and 11*c*′ (see FIG. 3) thereof and the inner peripheral surface 1″ of the front housing 1. An intake port 19 for guiding a fluid into the inner peripheral space 5 of the housing from the exterior of the pump and an outlet port 20 for guiding a fluid to the exterior from the inner peripheral space 5 of the housing are formed in the rear housing 2. Reference numerals 21, 21 designate tubes mounted on the intake port 19 and outlet port 20, respectively; 22 a bolt used to secure the bearing cover 8 to the rear housing 2; and 23, a nut in engagement with an external thread 10′ of the end of the rotational shaft 10 in order to secure the pulley 9 to the rotational shaft 10.

The operation of the above-described vane pump will be described hereinafter. When the rotational shaft 10 and rotor 4 are rotated by the drive force from the pulley 9, the vanes 11*a*, 11*b* and 11*c* also rotate, and the pins 13 and 13 projected on the vanes 11*a*, 11*b* and 11*c*, respectively, and the sleeve bearings 14 and 14 slipped over the pins 13 and 13 rotate along the annular races 17 and 17. Since as shown in FIG. 3, the inner peripheral surface 1″ of the housing and the annular race 17 are in coaxial relation and the annular race 17 and the rotor 4 are in eccentric relation, - the vanes 11*a*, 11*b* and 11*c* are radially slidably moved in the vane grooves 12*a*, 12*b* and 12*c* of the rotor 4 to be projected and retracted repeatedly with the result that the volumes of the working spaces 5*a*, 5*b* and 5*c* defined by both the housings 1, 2, the rotor 4 and the vanes 11*a*, 11*b* and 11*c* repeatedly increase and decrease. That is, in FIG. 3, the working space 5*a*, with the rotation, increases its volume to suck the fluid from the intake port 19 (not shown; see FIG. 1) opening to portion 5*a*; the working space 5*c*, with the rotation, decreases its volume to discharge the fluid into the outlet port 20 (not shown; see FIG. 1) opening to portion 5*c*; and the working space 5*b* transfers the thus sucked fluid toward the outlet port 20. In the above-described operation, the end edges 11*a*′, 11*b*′ and 11*c*′ of the vanes 11*a*, 11*b* and 11*c* are not in sliding contact with the inner peripheral surface 1″ of the front housing, as previously mentioned, and therefore, abrasion or high heat hardly occurs. In addition, the sleeve bearing 14 slipped over the pin 13 is slidably rotated while being pressed against the outside diameter side by the centrifugal force within the annular race 17 of the retainer rings 16*a* and 16*b* while the retainer rings 16*a* and 16*b* follow the sleeve bearing 14 for rotation because the former are in the state to be rotatable by the ball bearings 18*a* and 18*b*, respectively. The relative sliding speed between the sleeve bearing 14 and the annular race 17 is low whereby the abrasions of annular race 17, retainer rings 16*a* and 16*b*, the sleeve bearing 14 and the like can be minimized.

It is believed that the fundamental mode of the present invention is now fully understood from the above-described description. The pump of the first embodiment shown in FIGS. 1 to 3 constitutes, in a sense, the core of the variations described below.

Figure 4:
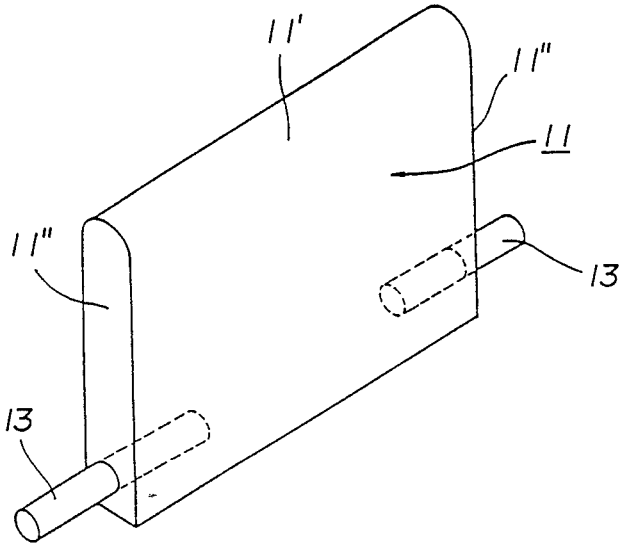
FIGS. 4, 5, 6 and 7 are perspective views of vanes, respectively.

FIG. 4 shows a mode different from the above-described first embodiment with respect to the technique in which projections are provided on the vane.

Figure 5:
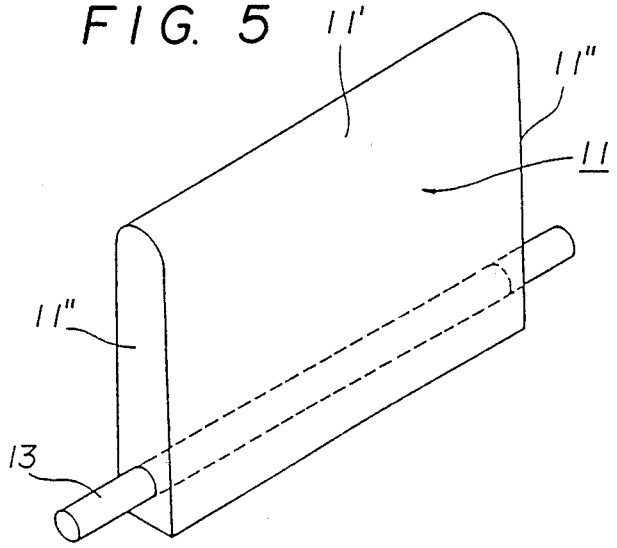
Figure 6:
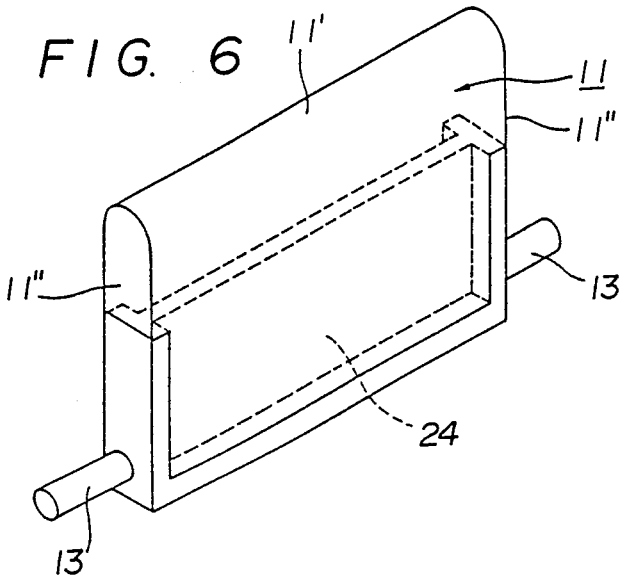
Figure 7:
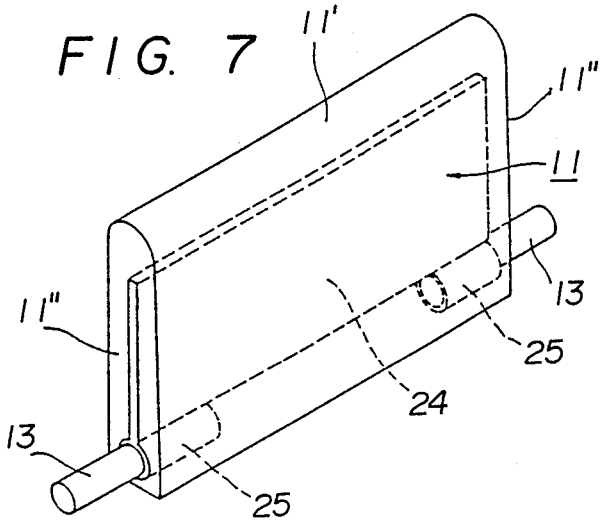

That is, in FIG. 4, cylindrical pins 13 made of iron or non-ferrous metal are embedded at positions one-sided on parts which form the inside diameter side in the state incorporated into the rotor 4 of opposite ends 11″ and 11″ of a plate-like vane 11 which is made of carbon or the like and in which end edges 11′ which form the outside diameter side in the state incorporated into the rotor 4 are formed into an arc. Alternatively, as shown in FIG. 5, a lengthy pin 13 is extended through and secured to the vane 11, and opposite ends of the pin 13 are projected; as shown in FIG. 6, pins 13 and 13 are embedded into the vane 11 and integrally provided by welding or the like on opposite ends of a plate-like reinforcing member 24 made of iron or non-ferrous metal such as aluminum; or as shown in FIG. 7, pins 13 and 13 are housed in tubular bodies 25 and 25 formed on opposite ends of a reinforcing member 24.

Several modes of embodiments of the present invention variously elaborated on the basis of the design of the pump according to the aforementioned first embodiment shown in FIGS. 1 to 3 will be discussed below.

Type 1

A vane pump belonging to the type 1 is characterized by having a vane wherein a vane body is coated with a non-lubricated sliding material using a metal plate having a required number of punched portions as a core, and projections are integrally secured to or integrally formed on the metal plate.

In the vane pump according to the aforementioned first embodiment, a great outward force caused by a centrifugal force exerts on the pin which is a projection to define the protrusion of the vane and the fixed portion between the pin and the vane, and therefore the strength of the fixed portion and the reduction in weight of the vane need be taken into consideration.

For this reason, an object of the aforesaid type 1 is to enhance the strength between the vane and the projection and reduce the weight of the vane.

In the vane of the pump belonging to this type 1, the projection is integral with the metal plate as the reinforcing core, and the base of the projection on the side of the metal plate is coated with non-lubricated sliding material, and therefore the strength is great. In addition, since the metal plate has the punched portions thus considerably reducing the weight, and the non-lubricated sliding materials on both sides of the metal plate are fused to each other through the punched portions, the strength of the vane body itself also increases.

One example of the vane belonging to the type 1 will be described below with reference to the drawings.

Figure 8:
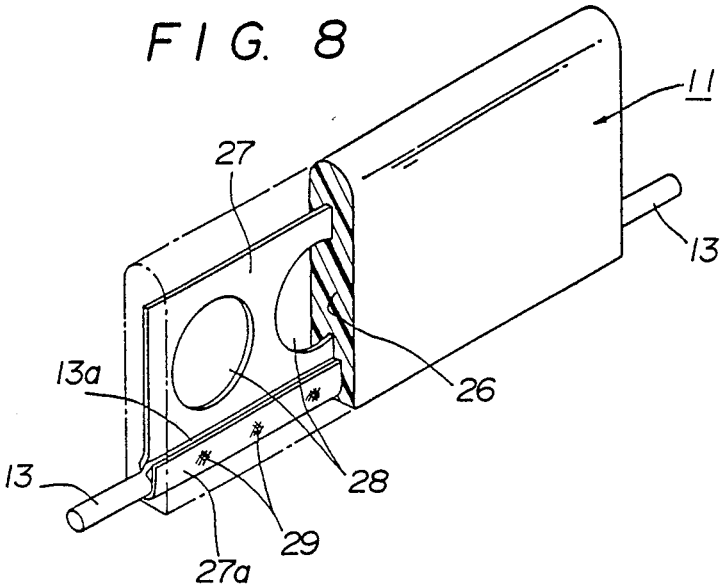
FIG. 8 is a perspective view, partly cutaway, of a vane of the pump belonging to Type 1.

Referring first to FIG. 8, reference numeral 11 designates a plate-like vane body coated with a non-lubricated sliding material 26 having excellent self-lubricating properties such as resins, molded carbon, etc. using a metal plate 27 made of steel or non-ferrous metal such as aluminum having a plurality of circular punched portions 28 as a core, and reference numeral 13 designates pins which are projections projected from opposite ends of the vane body 11. A base 13*a* of the pin 13 is caulked to one long side 27*a* of the metal plate 27 and is made integral with the metal plate 27 by applying spot welding at 29 to suitable points of the caulked portion.

Figure 9:
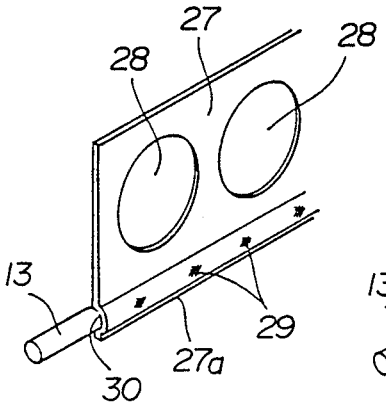
FIGS. 9, 10, 11, 12, 13 and 14 are respective perspective views of essential parts showing the internal construction of the vane belonging to the same Type 1.
Figure 10:
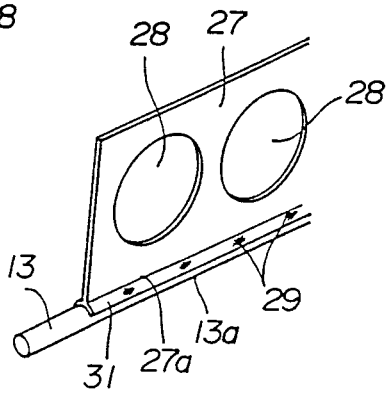
Figure 11:
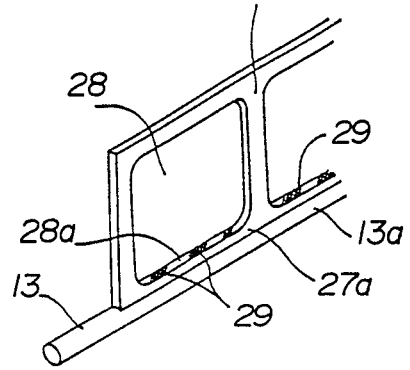
Figure 12:
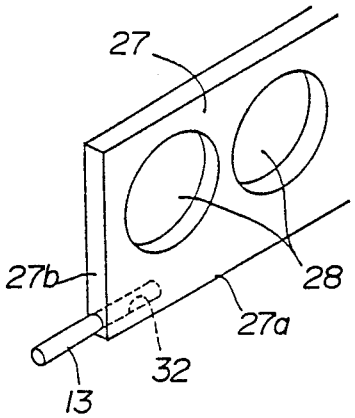

Modes of the fixed portion between the pin 13 and the metal plate 27 include an arrangement as shown in FIG. 9 in which a base (not shown) of a pin 13 is joined to a groove 30 formed in the vicinity of one long side 27*a* of the metal plate 27, and the base and the groove 30 are joined by spot welding at 29 at suitable points; an arrangement as shown in FIG. 10 in which a base 13*a* of a pin 13 is joined to a trough portion 31 formed integral with one long side 27*a* of a metal plate 27, and the base 13*a* and the trough portion 31 are joined by spot welding at 29 at suitable points; an arrangement as shown in FIG. 11 in which a punched portion 28 of a metal plate 27 is formed into a square, and one long side 27*a* of the metal plate 27 and a base 13*a* of a pin 13 are applied with spot welding at 29 from one edge 28*a* of the punched portion 28; and an arrangement as shown in FIG. 12 in which one long side 27*a* is interiorly formed with a pin receiving hole 32 from both ends 27*h* of a metal plate 27, and a pin 13 is hammered into the hole.

Figure 13:
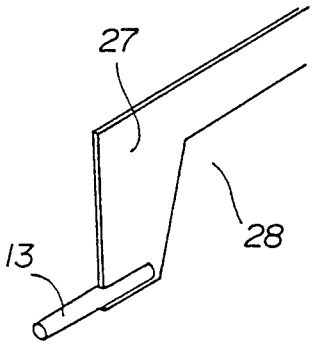
Figure 14:
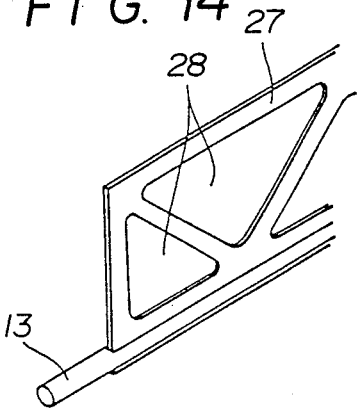

In addition, the pin 13 and the metal plate 27 may be integrally molded by molding means such as casting or forging as shown in FIGS. 13 and 14. The shape of the punched portion 28 has various modifications such as circular shapes as in FIGS. 8 to 10 and 12, a square shape as in FIG. 11, a cutout shape as in FIG. 13, and a triangular shape as in FIG. 14. Other shapes such as an oblong shape, a shape with a large number of pores, etc. may be used.

As described above, according to the vane for the pump described above, the supporting force against the protrusion of the vane during rotation by the projections on the opposite ends of the vane is strengthened, and therefore high-speed rotation becomes possible to enhance the feed force of the fluid under pressure. Accordingly, the pump may be miniaturized and reduced in weight. Furthermore, the metal plate serving as the core of the vane has the punched holes to suppress the increase in weight of the vane and the increase in the centrifugal force acting on the vane. Moreover, the non-lubricated sliding materials coated on both sides of the metal plate become fused to each other through the punched portions, and therefore the strength of the vane body itself also increases, thus providing a significant practical effect.

Type 2

A vane pump belonging to this type 2 has a vane for a pump characterized in that a cavity such as a cutout is formed in the base of the vane, mounting holes are made coaxially to each other in sleeves which are located on opposite sides of the cavity in a longitudinal direction, and projections of a single pin are inserted into the mounting holes, respectively. An object of the type 2 is, likewise to type 1, to enhance the projections and the fixed portion between the projections and the vane.

In the vane of the pump belonging to the type 2, the projections on the opposite ends of the vane are in the form of a single rod, and therefore, there is no local stress concentrated on the fixed portion relative to the vane (the fitted portion to the mounting hole), and the supporting force against the protrusion of the vane is enhanced. In addition, since the mounting holes through which the pin extends are divided by the cavity, a drilling process may be executed with high accuracy as compared to the case in which a single mounting hole passing through and between the opposite ends of the vane is bored, and in addition, the weight of the vane is reduced through a portion of the cavity.

One example of the vane belonging to the type 2 will be described below with reference to the drawings.

Figure 15:
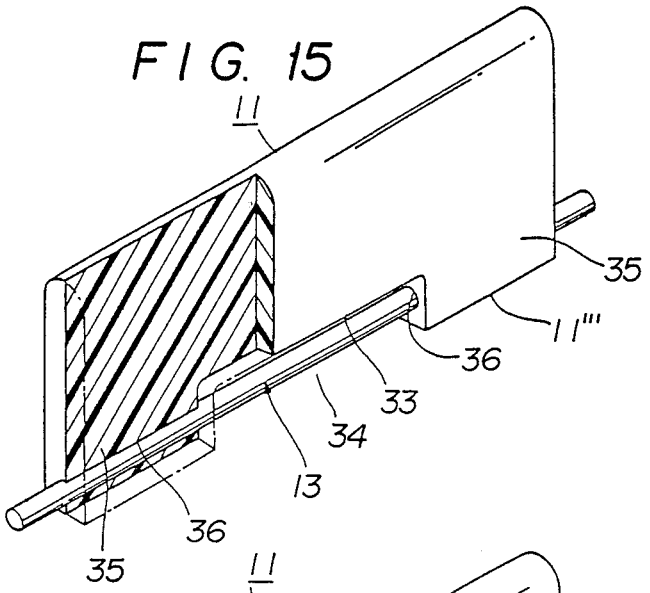
FIG. 15 is a perspective view, partly cutaway, of a vane of a pump belonging to Type 2.

First, in FIG. 15, a vane indicated at 11 is formed of a non-lubricated sliding material such as resin or molded carbon having excellent self lubricating properties, and a cutout 33 is made in the central portion of the base 11''' of the vane 11 to form a cavity 34. Mounting holes 36 are coaxially bored in sleeves 35 and 35, respectively, on opposite sides in a longitudinal direction of the cutout 33. Reference numeral 13 designates a single rod-like pin inserted into and secured in the mounting holes 36 and 36, and opposite ends of the pin 13 projecting from the sleeves 35 and 35 constitute projections, which peripherally slidably engage the annular race (see the number 17 of FIGS. 1 and 2) on the side of the pump housing to define the protrusion of the vane 11 during rotation.

Figure 16:
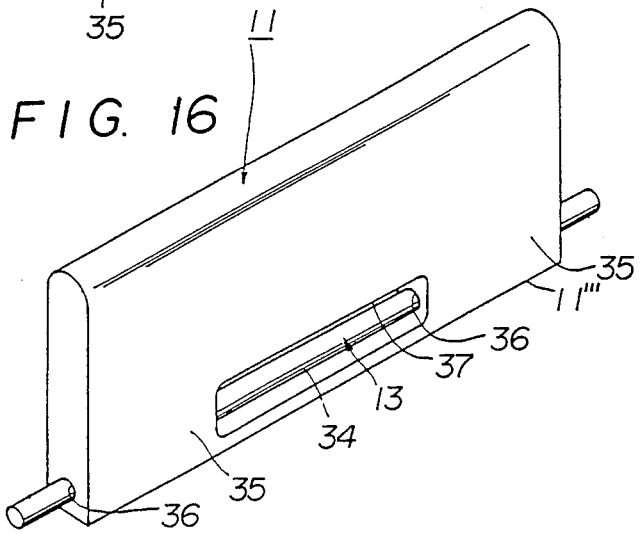
FIG. 16 is a perspective view of the vane of the pump belonging to the same Type 2.

Next, in FIG. 16, a window portion 37 is provided in the vicinity of the base 11''' in place of the cutout 33 shown in FIG. 15 to form a cavity 34, and other structures of FIG. 16 are similar to those shown in FIG. 15.

In the FIGS. 15 and 16 structure, local stress concentration hardly occurs between the vane 11 which tends to be moved out by the centrifugal force during rotation and the pin 13 to define it, as previously mentioned. Since each of the mounting holes 36 is short, their working may be carried out easily and with high accuracy, and the weight of the vane 11 is reduced through the portion of the cavity 34.

It is to be noted that the cavity 34 is subsequently filled with resins or the like whereby the fixing strength between the vane 11 and the pin 13 may be further increased.

As described above, according to the above-described vane, the fixing strength between the projections (pins) provided on the opposite ends of the vane and the vane is high to increase the supporting force against the protrusion of the vane during rotation, and therefore, high speed rotation becomes possible to enhance the feed force of the fluid under pressure. Accordingly, the pump may be miniaturized and reduced in weight. Moreover, the mounting holes through which the pins extend are divided by the cavity and shortened, and therefore drilling of the mounting holes may be carried out easily and with high accuracy, thus providing a great practical effect.

Type 3

A vane pump belonging to this type 3 has a vane for a pump characterized in that a vane body and the aforesaid projections are formed integral with each other of the same material. An object of the type 3 is to enhance the strength between the vane and the projections and reduce the weight of the vane, similarly to the types 1 and 2.

According to the vane for the pump belonging to the type 3, no local residual stress or stress concentration between the vane body and the projections is encountered, as in the case in which the vane body and the projections are formed from separate members, and they are joined together by fitting or the like, and the weight of the vane is small as compared to the case in which the projections are formed from metal rods fitted into the vane body.

One example of the vane belonging to the type 3 will now be described with reference to the drawings.

Figure 17:
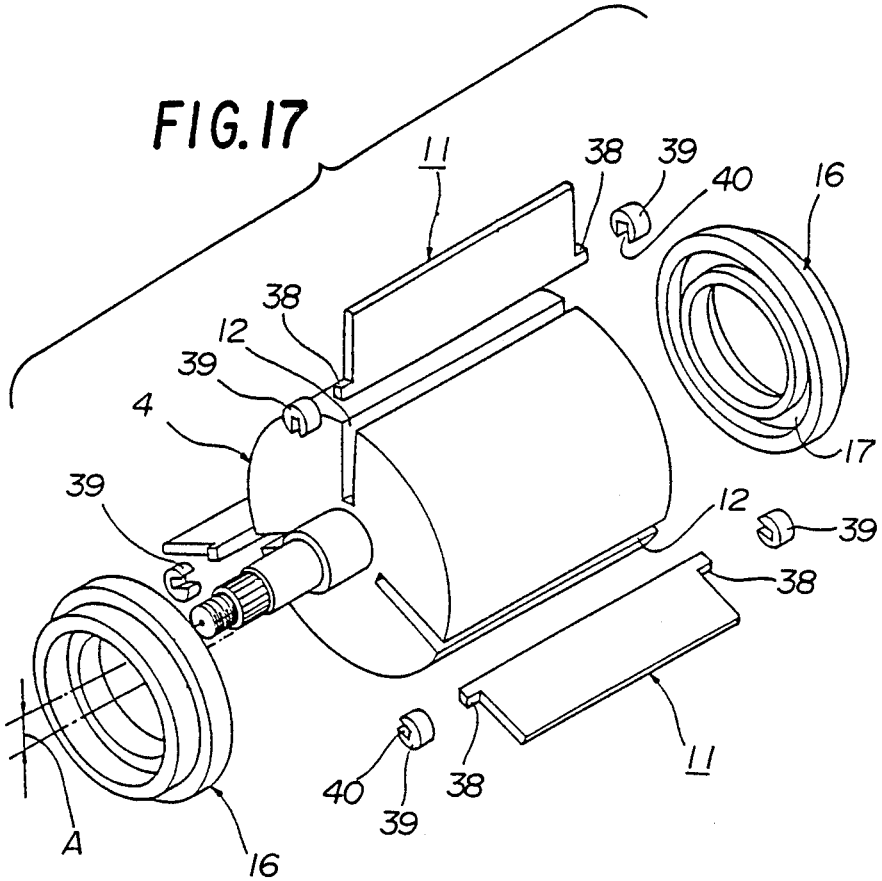
FIG. 17 is a perspective view of essential parts of a vane pump belonging to Type 3.

First, in FIG. 17, vanes indicated at 11 are disposed to be radially projected from and retracted into vane grooves 12, respectively, which are equally divided into three sections in a rotor 4 rotatably supported, in eccentric fashion, within a housing not shown, the vanes being formed of an iron sheet, light-weight non-ferrous metal such as aluminum, resins or the like, and prismatic projections 38 are projectingly molded integral with opposite ends in a longitudinal direction of the vane body taking the form of a plate. Sliding members indicated at 39 each having an approximately cylindrical contour are externally fitted at cutouts 40 having a ⊐-shaped section in the projections 38, respectively, the sliding members being formed of resins having excellent self-lubricating properties and abrasion resistance. A retainer ring indicated at 16 is rotatably mounted through a ball bearing not shown on each of the inner surfaces of the housing opposed to each of the end surfaces of the rotor 4 in the state in which the retainer is coaxial with the inner peripheral surface of the housing, in other words, it is eccentric at A with the rotor 4. The sliding members 39 externally fitted on the projections 38 of the vanes 11, respectively, peripherally slidably engage the annular races 17 formed in the opposed end of the retainer rings 16, whereby the protrusion of the vanes 11 from the vane grooves 12 caused by the centrifugal force during rotation are defined, and the vanes 11 are radially projected and retracted and rotated in the state of non-contact with the inner peripheral surface of the housing.

Figure 18:
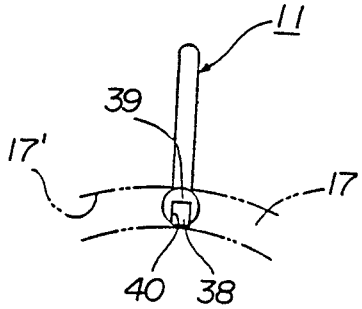
FIG. 18 is a side view of the vane of the same pump of Type 3.

According to the above-described arrangement, since the vane body of the vane 11 is molded integral with the projections 38, the local stress concentration caused by the load during rotation hardly occurs, and the weight of the vane is small. Therefore, the projections 38 can sufficiently support the vane body even during rotation at high speeds. As the vanes 11 rotate, the sliding members 39 smoothly slidably move along the peripheral wall 17' (shown in FIG. 18) on the outer peripheral side of the annular race 17, but the amount of slidable movement thereof is small because the annular race 17 (the retainer ring 16) is also synchronously rotated by the sliding contact therebetween.

Figure 19:
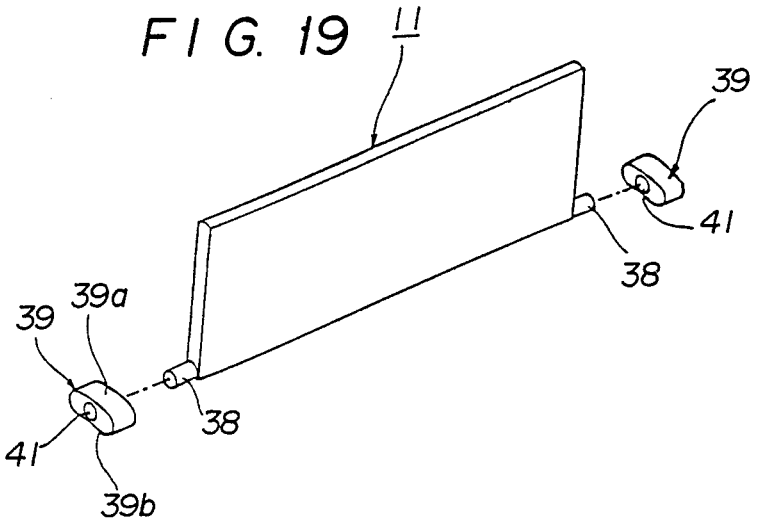
FIG. 19 is an exploded perspective view of the vane of the pump belonging to the same Type 3.
Figure 20:
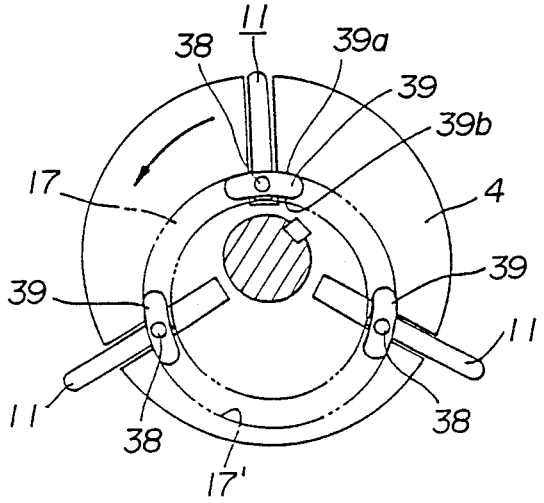
FIG. 20 is a side view of a rotor of the same pump of FIG. 19.

Next, the FIG. 19 arrangement is characterized in that projections 38 provided on opposite ends in a longitudinal direction of a vane body are formed into a cylindrical configuration, and sliding members 39 are formed into a somewhat elongated configuration having arched surfaces **39*a* and 39*b*; since an angle of the vane 11 to the annular race 17 is repeatedly varied within a predetermined range with rotation as shown in FIG. 20, the sliding members 39 are slipped over the projections 38 at circular holes 41 bored in the sliding members 39, respectively, to thereby enable relative oscillation with respect to the vane 11**.

According to the aforesaid arrangement, the arched surface **39*a* of the sliding member 39 comes into contact with the peripheral wall 17' of the annular race 17 by virtue of the centrifugal force during rotation, and the contact area is large so that the annular race 17 (the retainer ring 16**) may be smoothly rotated along therewith at the start. Moreover, since the pressing force per unit area in the contact surface lowers, mutual abrasion is also suppressed.

As described above, according to the above-described vane for the pump, the vane body and the projections to define the protrusion of the vane caused by the centrifugal force, by engagement with the annular race rotatably provided on the side of the housing, thereby enhance the supporting force of the projections with respect to the vane body and reduce the weight of the vane. Thereby, the pump may be run at high speeds, thus providing the excellent effects of realization of the miniaturization and reduction in weight of the pump.

Type 4

A van pump belonging to this type 4 is characterized in that projections are one-sided toward the inner peripheral surface of the housing rather than the lengthwise central portion between the opposite ends of the vane to form an annular race to have a larger diameter accordingly.

Figure 3:
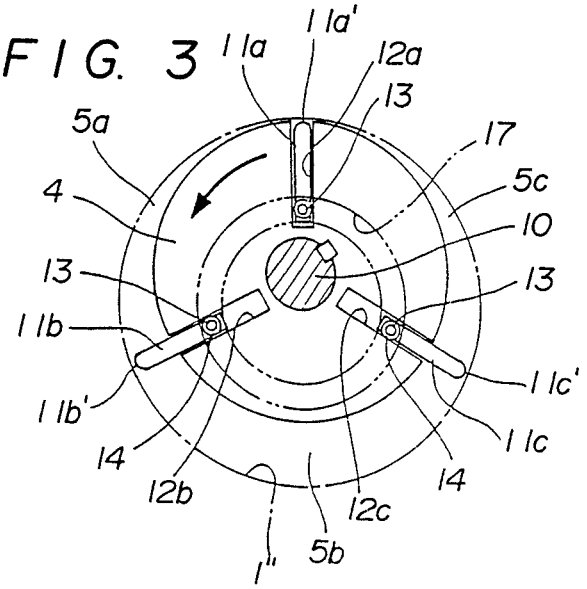
FIG. 3 is a side view of a rotor of the same pump of FIG. 1.

Also in the vane pump shown in FIGS. 1 to 3, in the case where the supporting of the vane 11 caused by the engagement between the projections 13 and the annular race 17 as shown therein is effected on the inside diameter side, an axial oscillation is derived to the vane 11 by repeated changes in pressure in the periphery of the vane 11 with pumping, to fail to perform radial parallel movement, and when the vane 11 is tilted, it comes into contact with the housing 1 to produce an abnormal noise and produce galling with an opening or the like internally of the intake port 19. In addition, such contact between the vane 11 and the housing 11 entails inconveniences such as a rise in temperature, lowering of the volume efficiency, the progress of abrasion, etc. caused thereby.

In light of the foregoing, the vane pump belonging to the type 4 is intended to suppress the oscillation of the vane during rotation to thereby prevent an occurrence of noises and to further enhance the pump performance.

For achieving the aforesaid object, the vane pump of the type as described has a rotor rotatably supported in eccentric fashion within an inner peripheral space of a housing and vanes each disposed to be projected from and retracted in each of a plurality of vane grooves formed in the rotor, wherein projections formed on opposite ends of each of the vanes are brought into peripherally slidable engagement with annular races provided coaxially and rotatably in the inner peripheral surface of the housing internally of the housing, and wherein the projections are to be positioned one-sided toward the inner peripheral surface of the housing rather than the lengthwise central portion between the opposite ends of the vane to form the annular races to have a larger diameter correspondingly. That is, since the supporting of the vanes against the protrusion thereof is effected on the side of the outside diameter, the axial oscillation of the outside diameter portion of the vane around the projections may be suppressed to prevent it from coming into contact with the housing.

One example of the vane pump belonging to the type 4 as described will now be described with reference to the drawings.

Figure 23:
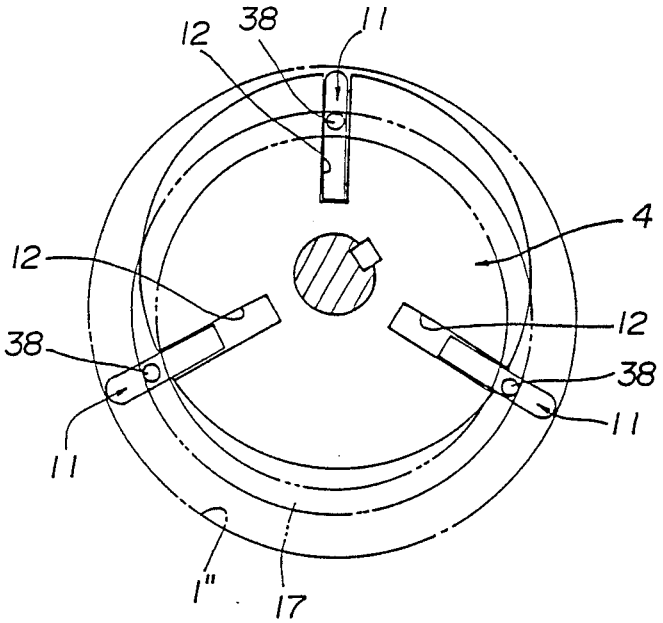
FIG. 23 is a side view of a rotor of the same pump of Type 4.
Figure 24:
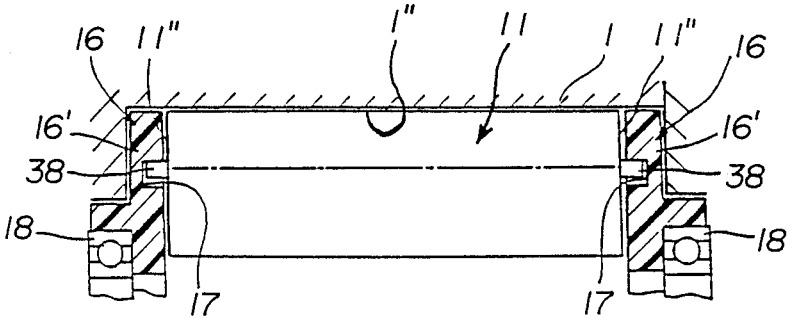
FIG. 24 is an explanatory view comparing the mounting state of the vane of the same pump with FIG. 21.

In FIGS. 22 to 24, projections 38 are formed on opposite ends 11'' of a vane 11 in an axial direction of a pump, the projections being positioned to be one-sided toward the inner peripheral surface of the housing 1 rather than the lengthwise central portion between the opposite ends 11'', in other words, toward the outside diameter side. Retainer rings indicated at 16 are rotatably mounted through ball bearings 18 on both inner surfaces of the housings 1 and 2 in a manner coaxial with said housings 1 and 2, that is, in the state eccentric with respect to the rotor 4 through a dimension indicated at A. An annular race 17 adapted to peripherally slidably engage the projection 38 of the vane is recessed in the end opposed to a flange 16' of each of the retainer rings 16, the annular race 17 being formed to have a large diameter corresponding to the projected position of the projection 38.

According to the above-described arrangement, the axial oscillation of the portion on the outside diameter side from the projection 38 of the vane (the portion above the phantom line in FIG. 24), around the projection 38, is suppressed, and the opposite ends 11'' of the vane in the axial direction of the pump are guided by the flanges 16' of the retainer rings 16, respectively, and therefore the contact thereof with the housings 1 and 2 will not occur.

As described above, according to the aforementioned vane pump, the projections in engagement with the annular races are provided one-sided toward the outside diameter side rather than the lengthwise central portion of the opposite ends of the vane in the radial direction of the pump to thereby suppress the axial oscillation of the vane during operation to prevent the contact thereof with the housings. The occurrence of abnormal noises, abnormal abrasion, and deterioration of volume efficiency resulting from such contact have been overcome, thus exhibiting an excellent performance for use with a supercharger, a compressor and the like for automobiles.

Type 5

A vane pump belonging to this type 5 is characterized in that a retainer ring coaxial with an inner peripheral space of a housing is fitted through a bearing internally of the end wall of the housing, and the retainer rings are engaged with the aforesaid vanes to define the protrusion of the vanes from the vane grooves, and a backup ring to suppress the oscillation of the retainer rings is interposed between the retainer ring and the end wall of the housing.

Since in the vane pump belonging to the type 5, the backup ring is interposed between the retainer ring and the end wall of the housing to suppress the oscillation of the retainer ring caused by the oscillation of the bearing in the thrust direction, the retainer ring may be smoothly rotated and the vane may be smoothly projected and retracted.

One example of the vane pump belonging to the type 5 will be described hereinafter with respect to the drawings.

Figure 25:
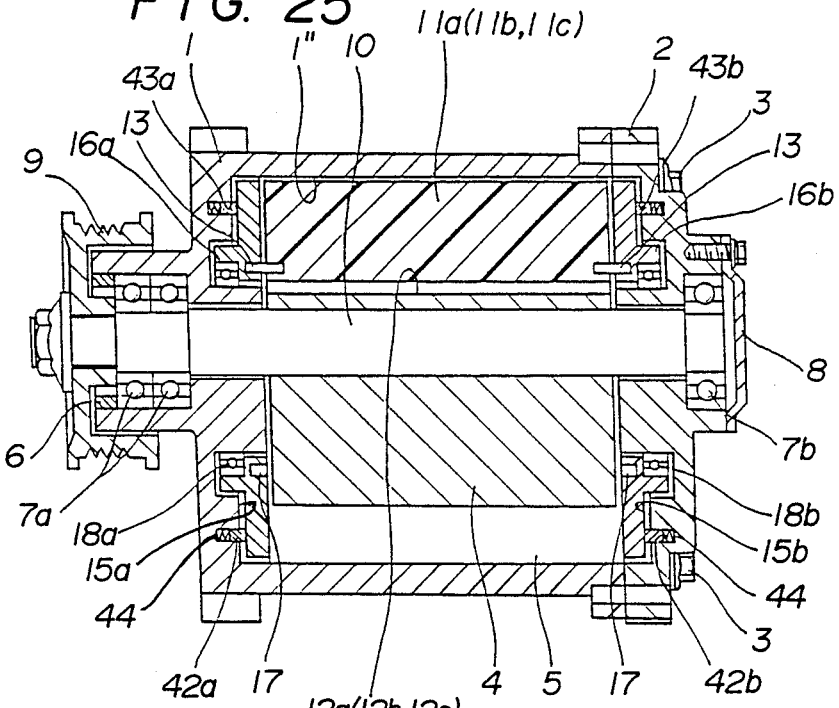
FIG. 25 is a sectional view of a vane pump belonging to Type 5.

As has been described so far and as again shown in FIG. 25, a clearance between members such as the rotor 4, retainer rings **16*a*, 16*b*, and vanes 11*a*, 11*b*, 11*c* to be projected and retracted with the rotation is set to be extremely small in view of the improvement in the pump efficiency. In addition, the vanes 11*a*, 11*b* and 11*c* are supported on the retainer rings 16*a* and 16*b* by the engagement between the pins 13 and the annular races 17, respectively, and the retainer rings 16*a* and 16*b* themselves need be firmly supported so as not to cause oscillations of the retainer rings 16*a* and 16*b* and smoothly rotated in order that the vanes 11*a*, 11*b* and 11*c* may be smoothly projected and retracted. However, practically, the retainer rings 16*a* and 16*b* are axially oscillated by the oscillations of the ball bearings 18*a* and 18*b* in the thrust direction and by the distribution of pressure within the working space 5, resulting in the contact thereof with the end walls of the housings 1 and 2, as a consequence of which the vanes 11*a*, 11*b* and 11*c* tend to be deviated or inclined. In the pump as herein proposed, taking this into consideration beforehand, backup rings 42*a* and 42*b* are interposed between the retainer rings 16*a* and 16*b* and the housings 1 and 2 to prevent the oscillations of the retainer rings 16*a* and 16*b*. The backup rings 42*a* and 42*b* formed of carbon or non-lubricated sliding material such as resins are fitted in annular grooves 43*a* and 43*b* positioned in parts of the annular recesses 15*a* and 15*b* formed in the end walls of the housings 1 and 2, the ends of which are placed in abutment with the backs of the retainer rings 16*a* and 16*b*. The backup rings are strengthened in supporting force by employment of a number of coil springs 44 as necessary to prevent oscillations of the retainer rings 16*a* and 16*b* so that the retainer rings 16*a* and 16*b* may not contact with the end walls of the housings to indirectly secure the smooth operation of the vanes 11*a*, 11*b* and 11*c***.

As described above, according to the vane pump as described above, the backup rings arc provided on the backs of the retainer rings to suppress the oscillations of the retainer rings to stabilize the rotation of the retainer rings. Therefore, it becomes possible to smoothly project and retract the vanes, thus preventing harmful influences resulting therefrom.

Type 6

A vane pump belonging to this type 6 is characterized in that bearings are rotatably mounted coaxially with the inner peripheral surface of a housing internally of both end walls of the housing, and projections provided on both side ends of vanes opposed to said end walls and the inner peripheral surfaces of the bearings are brought into contact with each other to define the protrusion of the vanes during rotation.

That is, the vane pump belonging to the type 6 is designed to use bearings in place of the retainer rings used in the vane pumps as previously described to save the trouble of forming annular races in the retainer rings. According to this arrangement, in the vane moved out of the vane groove by virtue of the centrifugal force during rotation, the projections on the opposite ends thereof come into contact with the inner peripheral surfaces of the bearings provided coaxially of the inner peripheral surface of the housing, in other words, in eccentric fashion with respect to the rotor whereby the radial movement thereof is defined, and the vane rotates in non-contact with the housing. In that case, the bearings are also rotated approximately in synchronism with the rotor by the contact of the projections of the vane, and therefore the relative sliding movement between the bearings and the projections of the vane can be minimized.

One example of the vane pump belonging to the type 6 will be described hereinafter with reference to the drawings.

Figure 26:
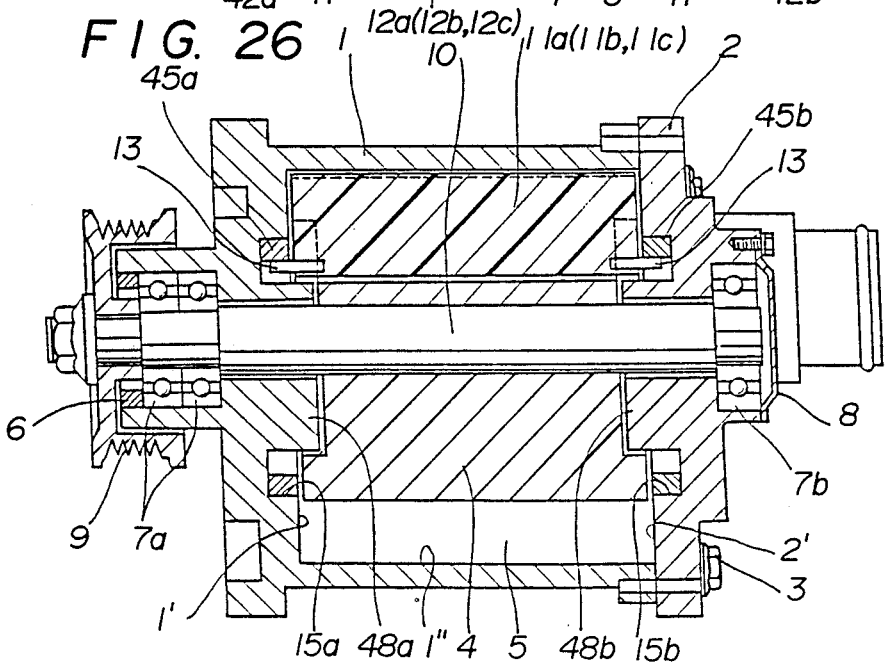
FIG. 26 is a sectional view of a vane pump belonging to Type 6.
Figure 27:
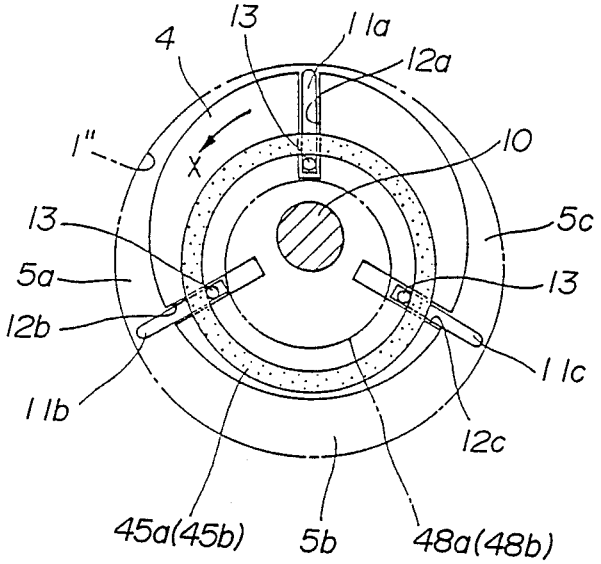
FIG. 27 is a side view of a rotor of the same pump of Type 6.
Figure 28I:
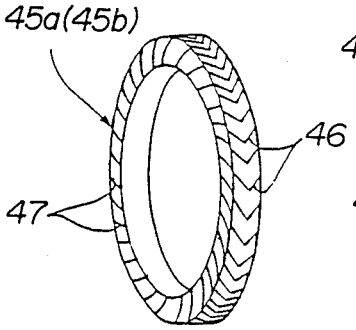
FIG. 28(I) and 28(II) are respective perspective views of retainer rings.
Figure 28:
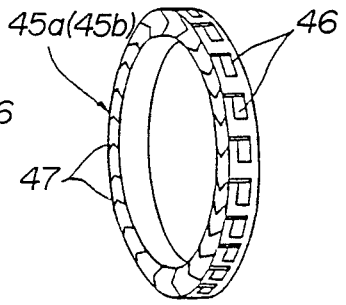

In FIGS. 26 and 27, journal bearings 45*a* and 45*b* formed of light-weight material such as aluminum are rotatably loosely mounted in annular recesses 15*a* and 15*b* formed coaxially with the inner peripheral surface of a housing in the inner surfaces 1' and 2' of both end walls of the housing, and the opposed peripheral surface (outer peripheral surface) and the opposed side with respect to the annular recesses 15*a* and 15*b* in journal bearings 45*a* and 45*b* are formed with dynamic pressure producing grooves 46 and 47 as shown in FIGS. 28(I) and 28(II). Pins 13 and 13 of vanes 11*a*, 11*b* and 11*c* are located on the inner peripheral sides of the journal bearings 45*a* and 45*b*, and the pins 13 and 13 come into contact with the inner peripheral surfaces of the bearings 45*a* and 45*b* during rotation whereby the vanes 11*a*, 11*b* and 11*c* are defined in their radial movement and can rotate in non-contact with the inner peripheral surface of the housing. Small-diameter bosses indicated at 48*a* and 48*b* are provided to impede unnecessary retraction of the vanes 11*a*, 11*b* and 11*c* into the vane grooves 12*a*, 12*b* and 12*c* when the pump stops, and to avoid an excessive shock between the pins 13 and 13 and the journal bearings 45*a* and 45*b* caused by the sudden protrusion of the vanes 11*a*, 11*b* and 11*c* when the pump starts, the bosses being projected concentric with the annular recesses 15*a* and 15*b*. This vane pump is constructed as described above. When the rotational shaft 10 and the rotor 4 are rotated in the direction as indicated at X by the drive force from the pulley 9, the vanes 11*a*, 11*b* and 11*c* rotate in non-contact with the front housing 1 and the rear housing 2 with the pins 13 and 13 placed in contact with the inner peripheral surfaces of the journal bearings 45*a* and 45*b* by virtue of the centrifugal force.

In the above-described operation, the vanes 11*a*, 11*b* and 11*c* are totally free from sliding contact with the front housing 1 and rear housing 12 as previously mentioned while the pins 13 and 13 integral with the vanes 11*a*, 11*b* and 11*c* come into sliding contact with the journal bearings 45*a* and 45*b*, but the amount of sliding contact thereof is small because the journal bearings 45*a* and 45*b* rotate approximately in synchronism with the rotor 4 by the frictional force with respect to the pins 13 and 13. Since the rotation of the journal bearings 45*a* and 45*b* is effected in a floated fashion by a great dynamic pressure produced in a fluid layer between the annular recesses 15*a* and 15*b* on the housing side by the dynamic pressure producing grooves 46 and 47, the sliding resistance is very small. For these reasons, it is possible to minimize the deterioration of the efficiency and abrasion resulting from the sliding resistance and sliding heat, and the temperature of the discharged fluid also lowers.

Figure 29:
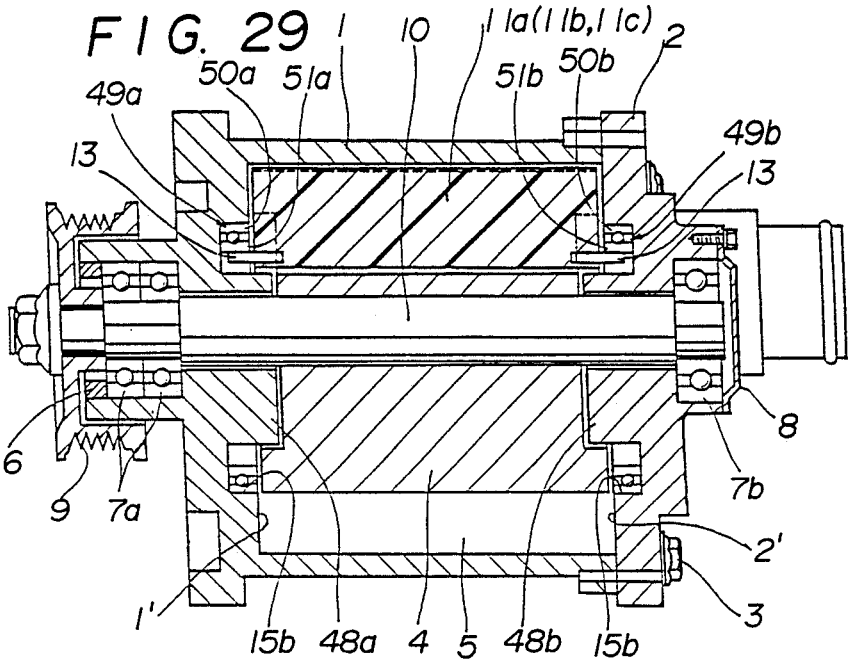
FIG. 29 is a sectional view of the vane pump belonging to the same Type 6.

Next, a pump shown in FIG. 29 uses ball bearings 49*a* and 49*b* in place of the journal bearings 45*a* and 45*b* in the pump shown in FIG. 26, and the ball bearings 49*a* and 49*b* are mounted in the annular recesses 15*a* and 15*b* of the inner surfaces 1' and 2' of both end walls of the housing. That is, the ball bearings 49*a* and 49*b* have their outer races 50*a* and 50*b* fitted and secured to the inner peripheral surfaces of the annular recesses 15*a* and 15*b*, and the pins 13 and 13 come into contact with the inner peripheral surfaces of the inner races 51*a* and 51*b* whereby the inner races 51*a* and 51*b* rotate approximately in synchronism with the rotor 4, which pump has the function substantially equal to the pump of FIG. 26.

It is to be noted that since the rotor is eccentric, the relative angle between the vane and the inner peripheral surface of the housing repeatedly varies as rotation proceeds, and therefore, in the event the protrusion of the vane is defined as shown in the aforesaid drawings, the locus of the end edge of the vane assumes an approximate elliptic shape. It is therefore desirable that the inner peripheral surface of the housing is formed into a shape corresponding to the aforesaid locus so as to always maintain constant a clearance between the end edge of the vane and the inner peripheral surface of the housing.

The vane pump described above is designed so that the projections provided on the opposite side ends of the vane are placed in contact with the inner peripheral surface of the bearings provided coaxial with the inner peripheral surface of the housing and rotatably to define the radial movement thereof so that the vane may be rotated in non-contact with the housing, as described above. Therefore, it is possible to minimize the deterioration of the pump efficiency and the advance of abrasion resulting from the sliding resistance and the high sliding heat and to lower the temperature of fluids discharged from the pump, this exhibiting excellence performances for use with various apparatuses such as a supercharger in an engine, a compressor in a freezing cycle, and the like.

Type 7

A vane pump belonging to this type 7 has a dynamic pressure bearing mechanism provided on the end or peripheral surface of a retainer, and particularly being characterized in that said dynamic pressure bearing mechanism comprises a groove or recess capable of producing dynamic pressure such as a spiral groove, a Rayleigh step groove or a herringbone groove or a recess or a combination of the aforesaid grooves and the recess.

Figure 30:
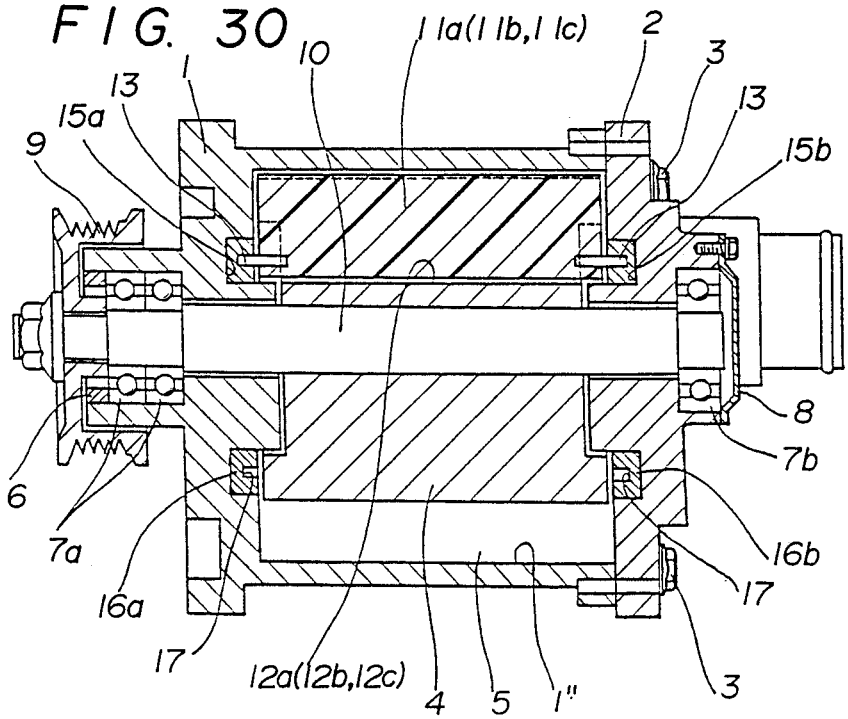
FIG. 30 is a sectional view of a vane pump belonging to Type 7.
Figure 31:
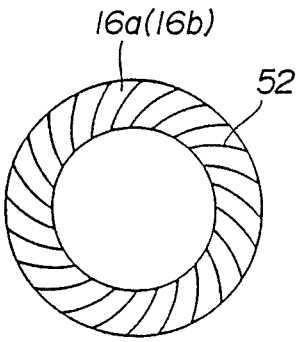
FIGS. 31, 32 and 33 are respective perspective views of retainer rings.
Figure 32:
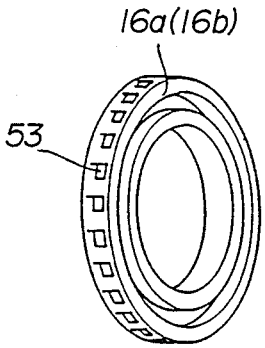
Figure 33:
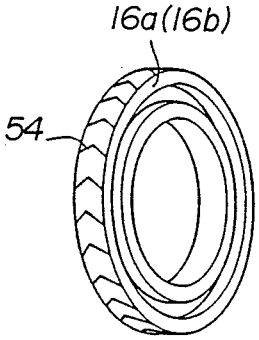

One example of the vane pump belonging to this type 7 will be described hereinafter with reference to the drawings. The outer ends of the retainer rings 16a and 16b mounted as shown in FIG. 30 opposed to the inner side of the housing 1 are formed with spiral grooves 52 as shown in FIG. 31, and the outer peripheral surfaces thereof formed with Rayleigh step grooves 53 and herringbone grooves 54 as shown in FIGS. 32 and 33. The dynamic pressure bearing mechanism is provided to smoothly rotate the retainer rings 16a and 16b with respect to the housing 1.

The pins 13 are slidably rotated while being pressed against the outside diameter side by the centrifugal force within the annular race 16 of the retainer plates 15a and 15b but the retainer plates 15a and 15b follow the pins 13 and rotate since the retainer plates 15a and 15b are in the state in which they may be smoothly rotated by the dynamic pressure bearing mechanism. The relative sliding speed between the pins 13 and the annular race 16 is very small thereby minimizing the abrasions of the annular race 16, retainer plates 15a, 15a, pins 13, etc. The aforesaid dynamic pressure bearing mechanism can be replaced, in addition to the already mentioned spiral grooves 52, Rayleigh step grooves 53 and herring-bone grooves 54, by various grooves, recesses and a combination of these which can produce dynamic pressure in a manner similar to the former.

Type 8

A vane pump belonging to this type 8 is characterized by the provision of means for defining a protrusion of vanes toward the inner peripheral surface of the housing, wherein small-diameter bosses coaxial with the inner peripheral surface of a housing are projected internally of both end walls of the housing to define a backward movement of the vanes into the vane grooves. With this, when the rotor stops, the inner end edges of the vanes come into contact with the outer peripheral surfaces of the bosses to check the excessive retraction of the vanes into the vane grooves, thus preventing an occurrence of a sudden protrusion of the vanes at the time of start. For more details, see FIGS. 26 and 29 and the description thereof.

Type 9

A pump belonging to the final type is characterized in that retainer rings with which vanes are engaged to define a protrusion of vanes toward the inner peripheral surface of a housing are provided coaxially with the inner peripheral surface of the housing internally of the opposite end walls of the housing so that they may be rotated, and the retainer rings and the rotor may be rotatively connected by means of a cam. An object of the pump is to rotate the retainer rings rotatively connected to the rotor through the cam in synchronism with the rotor to minimize the amount of sliding movement resulting from the engagement between the annular race and the projections.

One example of the vane pump belonging to the type 9 will be described below with reference to the drawings.

Figure 35:
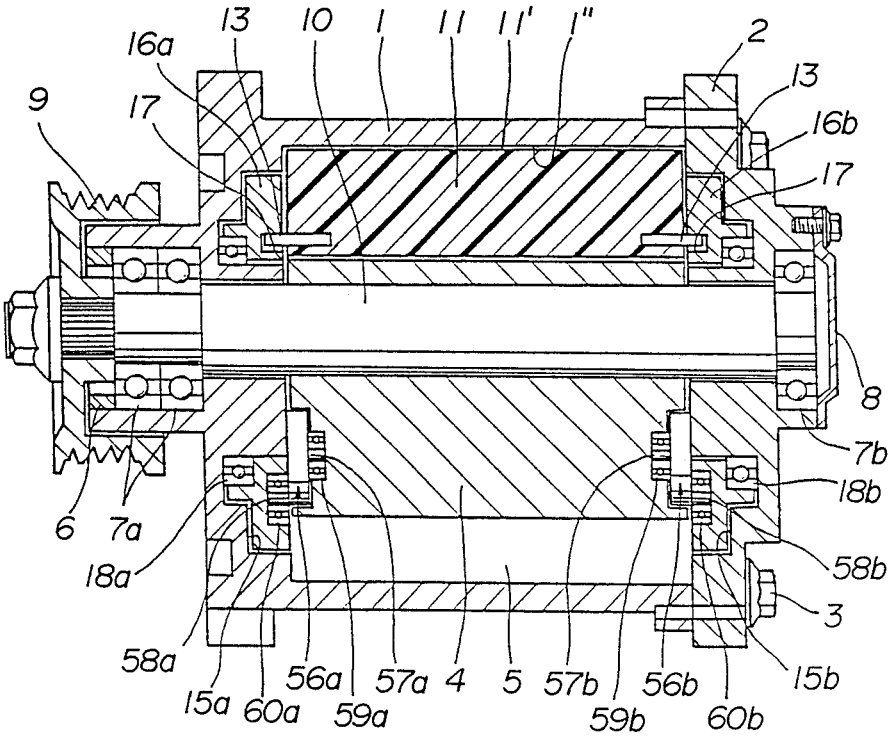
FIG. 35 is a sectional view showing the assembling state of the same pump of Type 8.
Figure 34:
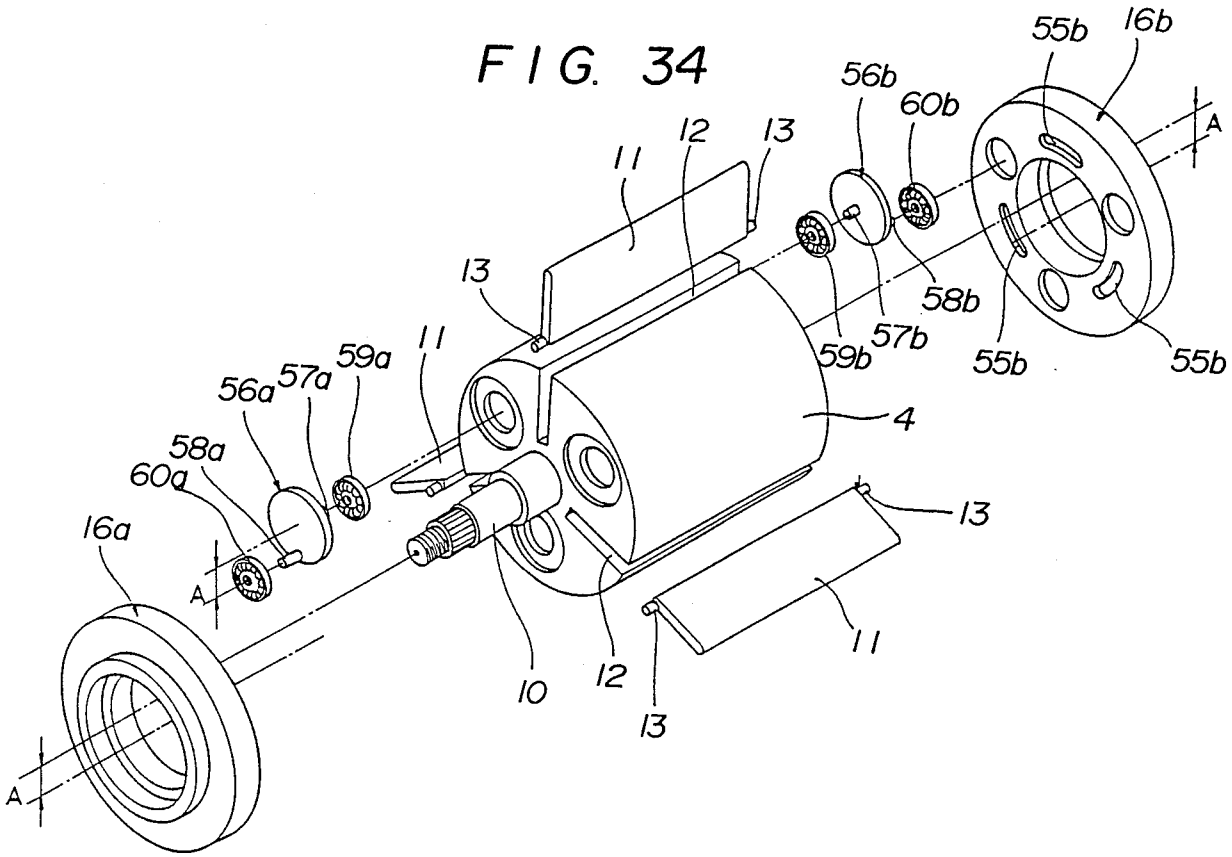
FIG. 34 is an exploded perspective view of a vane pump belonging to Type 8.
Figure 36:
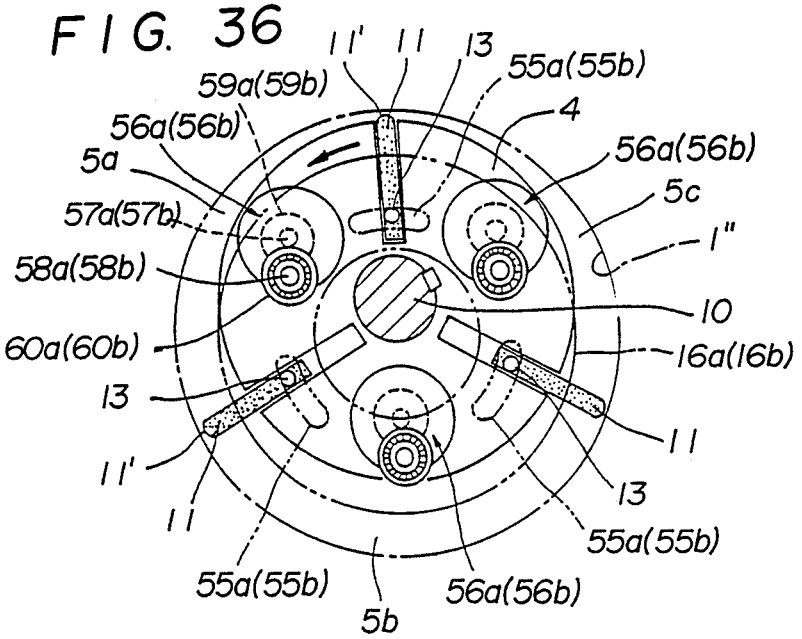
FIG. 36 is a side view of a rotor of the same pump of Type 8.

In FIGS. 34 to 36, a front housing indicated at 1 and a rear housing indicated at 2, which are formed of nonferrous metal such as aluminum having a small coefficient of thermal expansion, are integrally secured to each other by means of bolts 3. A rotor 4 made of iron eccentrically inserted into an inner peripheral space 5 of the housing is extended through both the housings 1 and 2 through a ball bearing 7a held by a fixed ring 6 in anti-slipout fashion in an axial shoulder of the front housing 1 and a ball bearing 7b held by a bearing cover 8 in anti-slipout fashion in an axial shoulder of the rear housing 2 and is rotatably mounted on a rotational shaft 10 to which a drive force is transmitted from a pulley 9. Plate-like vanes 11, principally made of a carbon material having an excellent slidability, are disposed to be radially projected and retracted in vane grooves 12, respectively, which are formed in the form of depressions equally spaced apart so as to peripherally divide the outer peripheral side of the rotor 4 into three sections, on the rotor. Projections 13 and 13 are provided on opposite side ends in an axial direction of each vane 11, and a sliding member (not shown) made of resin having excellent slidability and abrasion resistance is slipped over the projection 13 as needed. Retainer rings 16a and 16b formed of non-ferrous metal such as aluminum and having arched grooves 55a, 55b peripherally equally divided into three sections are rotatably mounted through ball bearings 18a and 18b, respectively, in annular recesses 15a and 15b formed coaxial with the inner peripheral surface 1'' of the front housing 1 in the inner surfaces 1' and 2' of the front housing 1 and rear housing 2. The projections 13 and 13 provided on the vanes 11 are slidably engaged with the arched grooves 55a, 55b of the retainer rings 16a and 16b to define the radial movement of the vanes 11 during rotation so as to always maintain a fine clearance between each of the end edges 11' and the inner peripheral surface 1'' of the housing. Cams indicated at 56a, 56b are provided to rotatively connect the rotor 4 and the retainer rings 16a and 16b at their opposed ends, and pins 57a and 57b of the cams 56a and 56b, respectively, are fitted through ball bearings 59a and 59b in positions where the opposite ends of the rotor 4 are peripherally equally divided into three sections while the other pins 58a and 58b are fitted through ball bearings 60a and 60b in positions where the ends of the retainer rings 16a and 16b, respectively, are peripherally equallY divided into three sections. The distance between the centers of the pins 57a, 57b and 58a, 58b equals an amount of eccentricity of the rotor 4 with respect to the inner peripheral surface 1'' of the housing, in other words, an amount of eccentricity A of the rotor 4 and the retainer rings 16a and 16b, that is, the pins 57a, 57b and 58a, 58b maintain their same angular positional relation with each other and rotate on the circumference of the same diameter with eccentricity of amount A. Incidentally, the loci of the vane grooves 12 and the loci of the arched grooves 55a, 55b are naturally in eccentric relation, and therefore, in the case where the retainer rings 16a and 16b are synchronously rotated by the cams 56a, 56b, the projections 13 and 13 of the vanes 11 are displaced, with the rotation, in the range of length about twice the amount of eccentricity A relative to the arched grooves 55a and 55b. Accordingly, the arched grooves 55a and 55b are set to the length above the aforesaid displacement.

In the above-described arrangement, when the rotational shaft 10 and the rotor 4 are rotated by the drive force from the pulley 9, the vanes 11 rotate accordingly, and the retainer rings 16a and 16b rotatively connected to the rotor 4 by the cams 56a and 56b also rotate. Here, the protrusion of the vanes 11 toward the inner peripheral surface 1'' of the housing by the centrifugal force is defined by the engagement between the projections 13 and 13 of the vanes 11 and the arched grooves 55*a* and 55*b* of the retainer rings 16*a* and 16*b*, as previously mentioned, and therefore the vanes 11 rotate in the state leaving a fine clearance with respect to the inner peripheral surface 1″ of the housing. Also, the loci of the arched grooves 55*a* and 55*b* are in coaxial relation for the inner peripheral surface 1′ of the housing while in eccentric relation for the rotor 4, and therefore, with the aforesaid rotation, the vanes 11 radially slidably move within the vane grooves 12 of the rotor 4 for repeated projection and retraction, and the volumes of the working spaces 5 defined by the housings 1, 2, the rotor 4 and the vanes 11 repeatedly increase and decrease to effect suction and discharge of fluids.

In a series of operation as described above, the vanes 11 are not in contact with the inner peripheral surface 1′ of the housing, and therefore, there occurs no power loss or generation of high heat due to the sliding torque, early advance of abrasion, and the like; the amount of sliding between the projections 13, 13 of the vanes 11 and the arched grooves 55*a*, 55*b* is restricted to the range approximately twice the amount of eccentricity A; and the relative sliding speed thereof is small since the retainer rings 16*a* and 16*b* rotate in synchronism with the rotor 4.

Figure 37:
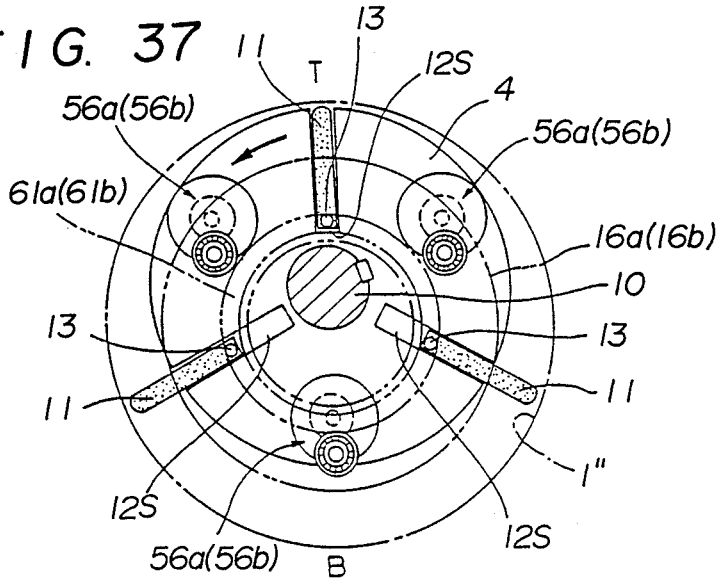
FIG. 37 is a side view of a rotor of the pump belonging to the same Type 8.
Figure 38:
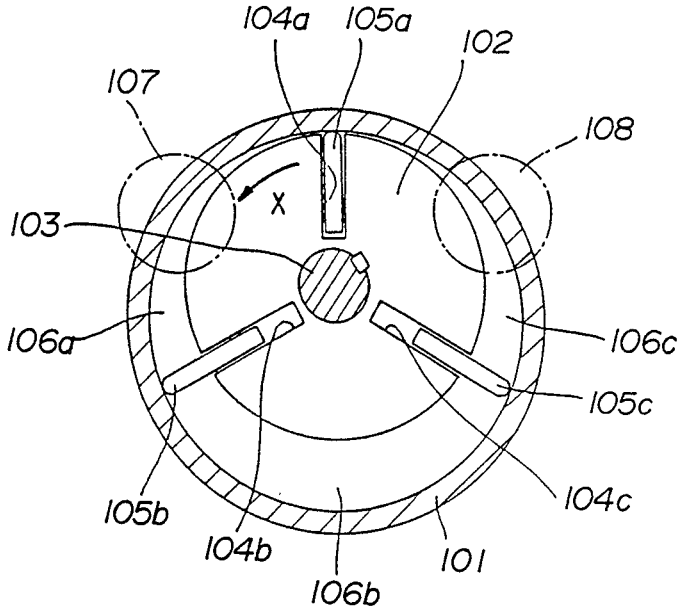
FIG. 38 PRIOR ART
FIG. 38 is a sectional view showing one example of a vane pump according to the prior art.

Next, the pump shown in FIG. 37 is different from those shown in FIGS. 34 to 36 in that the projections 13 and 13 provided on the opposite side ends in the axial direction of the vanes 11 are slidably engaged with the interior of the annular grooves 61*a* and 61*b* formed in the retainer rings 16*a* and 16*b*. Also in this case, the retainer rings 16*a* and 16*b* are rotated in synchronism with the rotor 4 through the cams 56*a*, 56*b* whereby the projections 13 and 13 are merely slidably moved with the annular grooves 61*a* and 61*b* in the range of length about twice the amount of eccentricity of the rotor 4, and the relative sliding speed thereof is exactly the same as that of FIG. 34.

Incidentally, a bottom space 12S of each vane groove 12 which is the inside of each vane has a volume which repeatedly increases and decreases with the projection and retraction of the vane 11, and accordingly, the pressure within the bottom space 12S acting as a back pressure on the vane 11 also repeatedly varies. This will be further described. In rotation of the vane 11 from the top T toward the bottom B, the vane 11 is in the stage in which the vane projects from the vane groove 12, and the volume of the bottom space 12S gradually enlarges and the internal pressure lowers, while in rotation of the vane 11 from the bottom B toward the top T, the vane 11 is in the stage in which the vane retracts into the vane groove 12, and the volume of the bottom space 12S gradually contracts and the internal pressure rises. That is, the change in the internal pressure of the bottom space 12S resulting from the rotation always exerts in the direction of impeding the projection and retraction operation of the vane 11, and thus there is a possibility of deteriorating the pump efficiency. In the pump as described, the annular grooves 61*a* and 61*b* provided for engagement of the projections of the vanes 11 have the advantage by which such unstable elements as described above are overcome. That is, since the axial side ends of the bottom spaces 12S open to the annular grooves 61*a* and 61*b*, the fluid within the bottom space 12S whose volume is being contracted freely flows into the other bottom space 12S whose volume is being enlarged through the annular grooves 61*a* and 61*b*, so as to minimize the change in the internal pressure.

It is noted in the vane pump that in view of the feature in which the rotor is eccentric with respect to the housing, the relative angle formed between the inner peripheral surface of the housing and the vane repeatedly varies with the rotation thereof. Accordingly, in the pump as described above, where the protrusion of the vanes 11 caused by the engagement between the projections 13, 13 and the arched grooves 55*a*, 55*b* or the annular grooves 61*a*, 61*b* is defined on the relatively inner peripheral side, the locus of the end edge 11′ of the vane assumes an approximate elliptic configuration. Therefore, it is desirable that the inner peripheral surface 1″ of the housing is formed into a shape corresponding to that locus to always maintain constant a clearance between the end edge 11′ of the vane and the inner peripheral surface 1″ of the housing.

As described above, the vane pump belonging to the aforesaid type is designed so that the vanes are rotated in non-contact with the housing by the provision of the retainer rings which define the protrusion of the vanes toward the inner peripheral surface of the housing, and the retainer rings are rotatively connected for synchronous rotation with the rotor by means of the cams to minimize the sliding movement resulting from the engagement between the retainer rings and the vanes, thus exhibiting excellent advantages which can prevent deterioration of pump efficiency due to sliding resistance and high sliding heat and the early advance of abrasion and which can lower the temperature of the fluid discharged out of the pump. The pump is extremely suitable for use with the supercharger of an engine, the compressor of a freezing cycle, and the like.

Exemplification (II)

A further exemplification of a vane pump according to the present invention will be described hereinafter with reference to FIGS. 39 to 45.

Figure 39:
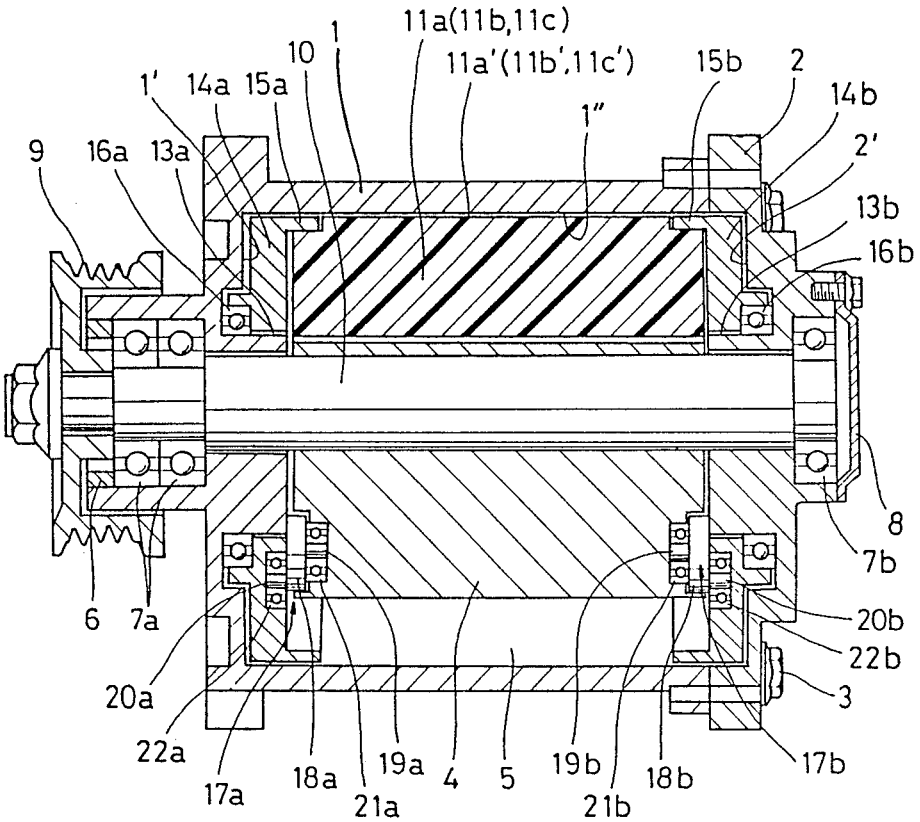
FIG. 39 is a sectional view of a vane pump according to another exemplification of the present invention.
Figure 40:
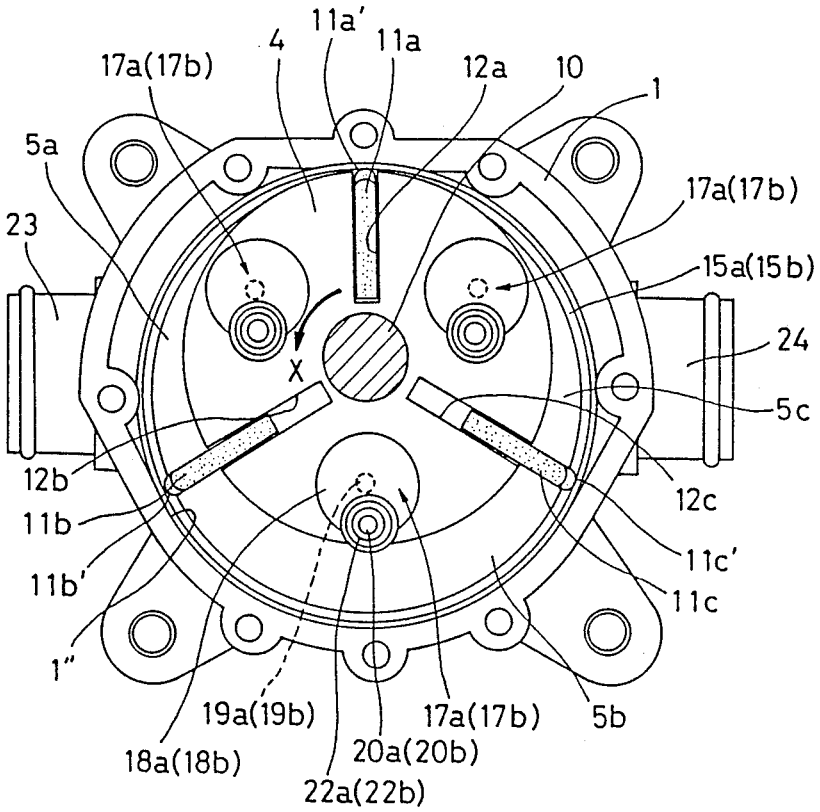
FIG. 40 is an explanatory view of an internal construction of the FIG. 39 pump viewed axially.

In FIGS. 39 and 40 showing a first embodiment, a front housing 1 and a rear housing 2, which both housings are made of non-ferrous metal such as aluminum which is light in weight and is small in coefficient of thermal expansion, are secured integral with each other by means of bolts 3. A rotor 4 made of iron eccentrically inserted into an inner peripheral space 5 of the housing is extended through both the housings 1 and 2 through a ball bearing 7*a* held by a fixed ring 6 in anti-slipout fashion in an axial shoulder of the front housing 1 and a ball bearing 7*b* held by a bearing cover 8 in anti-slipout fashion in an axial shoulder of the rear housing 2 and is rotatably mounted on a rotational shaft 10 to which a drive force is transmitted from a pulley 9. Plate-like vanes 11*a*, 11*b* and 11*c* principally made of a carbon material having an excellent slidability are disposed to be radially projected and retracted in vane grooves 12*a*, 12*b* and 12*c*, respectively, which are formed in the form of depressions equally spaced apart so as to peripherally divide the outer peripheral side of the rotor 4 into three sections, on the rotor 4. In inner surfaces 1′ and 2′ opposed to each other of end walls of the front housing 1 and rear housing 2 are provided peripheral shoulders 13*a* and 13*b* formed coaxial with the inner peripheral space 5 of the housing (coaxial with the inner peripheral surface 1″ of the front housing 1). Retainer plates 14*a* and 14*b* formed of non-ferrous metal such as aluminum and having a diameter slightly smaller than the inner peripheral surface 1″ of the housing are rotatably mounted on the peripheral shoulders 13*a* and 13*b* through ball bearings 16*a* and 16*b*. On the outer peripheral ends of the retainer plates 14*a* and 14*b* are formed annular stoppers 15*a* and 15*b* projected parallel to the axis and adapted to define the protrusion of the vanes 11*a*, 11*b* and 11*c*. Reference numeral 17*a* designates a cam whereby the rotor 4 and the retainer plate 14*a* are rotatably connected between opposed ends thereof and is constructed such that a pin 19*a* rotatably axially inserted in a position where one end of the rotor 4 is peripherally equally divided into three sections through a ball bearing 21*a* is secured in the central portion of one side of each disk 18*a*, and a pin 20*a* rotatably axially inserted in a position where the retainer plate 14*a* is peripherally equally divided into three sections through a ball bearing 22*a* is secured to the outer end of the other side of each disk 18*a*. Reference numeral 17*b* designates a cam whereby the rotor 4 and the retainer plate 14*a* are rotatably connected between opposed ends thereof and is constructed such that a pin 19*b* rotatably axially inserted in a position where the other end of the rotor 4 is peripherally equally divided into three sections through a ball bearing 21*b* is secured in the central portion of one end of each disk 18*b*, and a pin 20*b* rotatably axially inserted in a position where the retainer plate 14*b* peripherally equally divided into three sections through a ball bearing 22*b* is secured to the outer end of the other side of each disk 18*b*. The pins 19*a*, 19*b* and pins 20*a*, 20*b* are on the circumference of the same diameter eccentric to each other by an eccentric amount of the rotor 4. The retainer plates 14*a*, 14*b* are rotated in synchronism with the rotor 4 by the cams 17*a*, 17*b*. Reference numeral 23 designates an intake port for introducing a fluid from the outside into the inner peripheral space 5 of the housing, and reference numeral 24 designates a discharge port for introducing a fluid from the inner peripheral space 5 of the housing toward the outside.

Next, the operation of the aforementioned vane pump will be described. When the rotational shaft 10 and the rotor 4 are rotated in the direction as indicated at X by the drive force from the pulley 9, the vanes 11*a*, 11*b* and 11*c* also rotate. Here, the protrusion the vanes 11*a*, 11*b* and 11*c* caused by the centrifugal force resulting from the aforesaid rotation is defined by the contact between the rotor 4 and the stoppers 15*a* and 15*b* on the outer peripheral ends of the retainer plates 14*a* and 14*b*, and accordingly, the vanes 11*a*, 11*b* and 11*c* rotate in a state leaving a slight clearance (in a non-contact state) between the vanes and the inner peripheral surface 1″ of the housing and are in a state not in contact with both the inner surfaces 1′ and 2′ of the housing with the provision of the retainer plates 14*a* and 14*b*. Since the inner peripheral surface 1″ and the stoppers 15*a*, 15*b* are in a relation of being coaxial with each other and the stoppers 15*a*, 15*b* and the rotor 4 are in a relation of being eccentric with each other, the vanes 11*a*, 11*b* and 11*c* are radially slidably moved in the vane grooves 12*a*, 12*b* and 12*c* of the rotor 4 and repeatedly projected and withdrawn. As the result, the volume of the working spaces 5*a*, 5*b* and 5*c* defined by the housings 1, 2, the rotor 4 and the vanes 11*a*, 11*b* and 11*c* is repeatedly increased and decreased. That is, FIG. 40 shows the process in which the working space 5*a* increases its volume as the rotation takes place and sucks the fluid from the intake port 23 open to portion 5*a*;the working space 5*c* decreases its volume as the rotation takes place and discharges the fluid into the discharge port 24 open to portion 5*c*; and the working space 5*b* transfers the sucked fluid toward the discharge port 24.

In the above-described operation, the vanes 11*a*, 11*b* and 11*c* are totally free from sliding contact with the inner peripheral surface 1″ of the housing and both the inner surfaces 1′ and 2′, and the end edges 11*a*′, 11*b*′ and 11*c*′ of the vanes come into sliding contact with the stoppers 15*a*, 15*b* of the retainer plates 14*a*, 14*b* only at their both axial side ends. However, since the stoppers 15*a*, 15*b* are rotated in synchronism with the rotor 4, the aforesaid sliding amount is small and thus the lowering of the efficiency and the advance of the wear resulting from sliding resistance and sliding heat generation can be minimized, and the temperature of the fluid discharged from the discharge port 24 can be lowered. In addition, according to the aforementioned arrangement, since the stoppers 15*a*, 15*b* which define the protrusion of the vanes 11*a*, 11*b* and 11*c* are very close to the inner peripheral surface 1″ of the housing, the locus of the end edges 11*a*′, 11*b*′ and 11*c*′ of the vanes is approximately circular in shape, despite the repeated change of the relative angle between the vanes 11*a*, 11*b* and 11*c* and the inner peripheral surface 1″ of the housing, and the vanes rotate always leaving a given fine clearance (in a state not in contact) relative to the inner peripheral surface 1″ of the housing. While in the above-described embodiment, the cam is used to rotate the retainer plates in synchronism with the rotor, it is noted that similar effects may be obtained by an arrangement wherein the retainer plates are rotated approximately in synchronism with the rotor by the frictional force between the vanes and the stoppers. In addition, while in the above-described embodiment, the stoppers are annularly formed, it is noted that in the case where the retainer plates are rotated in synchronism with the rotor by the cam, portions of the stoppers in contact with the vanes are restricted, and therefore the stoppers can be formed in the form of an arc corresponding to those portions.

Figure 41:
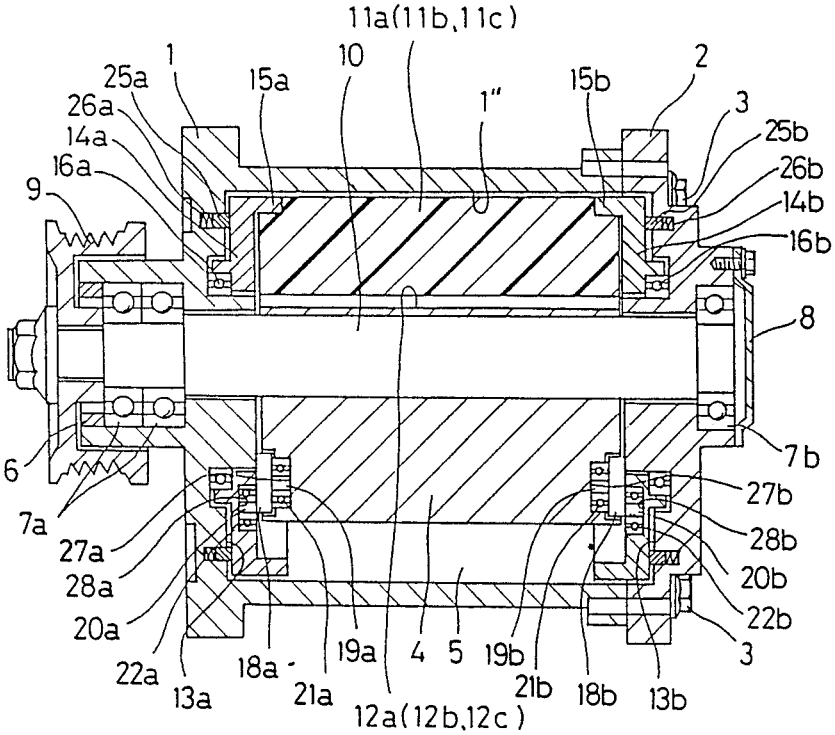
FIG. 41 is a sectional view of a vane pump according to a further embodiment of the present invention.

Next, a second embodiment of the present invention will be described with reference to FIG. 41. The second embodiment is, in addition to the features of the pump according to the first embodiment, characterized in that back-up rings 25*a* and 25*b* for restraining a deflection of the retainer plates are interposed between the retainer plates and the end wall of the housing. The vanes 11*a*, 11*b* and 11*c* are supported on the retainer plates 14*a* and 14*b* by contact of the vanes with the stoppers 15*a* and 15*b* as previously described. To provide the smooth projection and retraction of the vanes 11*a*, 11*b* and 11*c*, the retainer plates 14*a* and 14*b* must be firmly supported and smoothly rotated in order not to oscillate the retainer plates 14*a* and 14*b*. Practically, however, the ball bearings 16*a* and 16*b* oscillate in the thrust direction, and the retainer plates 14*a* and 14*b* oscillate due to the pressure distribution within the working space 5 into contact with the end walls of the housings 1 and 2, resulting in a deviation or an inclination of the vanes 11*a*, 11*b* and 11*c*. The present pump takes this into consideration beforehand, and the backup rings 25*a* and 25*b* are interposed between the retainer plates 14*a* and 14*b* and the end walls of the housings 1 and 2 to prevent the oscillation of the retainer plates 14*a* and 14*b*. The backup rings 25*a* and 25*b* made of non-lubrication sliding material such as carbon and resin are fitted in the annular grooves positioned partly of the peripheral shoulders 13*a* and 13*b*, and the ends thereof are brought into contact with the back of the retainer plates 14*a* and 14*b*. In addition, a number of coil springs 26*a* and 26*b* are provided as needed to strengthen the supporting force, thus preventing the oscillation of the retainer plates 14a and 14b to prevent the retainer plates 14a and 14b from contacting the end wall of the housing to indirectly secure the smooth operation of the vanes 11a, 11b and 11c. In this pump, the cams 17a and 17b may be removed to simplify the construction; and when a dynamic pressure bearing such as a spiral groove, a herringbone groove, etc. is provided in a contact surface between the retainer plates 14a, 14b and the backup rings 25a, 25b, the sliding resistance of this portion can be reduced to make the rotation of the retainer rings 14a and 14b smooth. Reference numerals 27a, 27b, 28a and 28b designate recesses for receiving the cams 17a, 17b, and bearings 21a, 21b, 22a and 22b.

Figure 42:
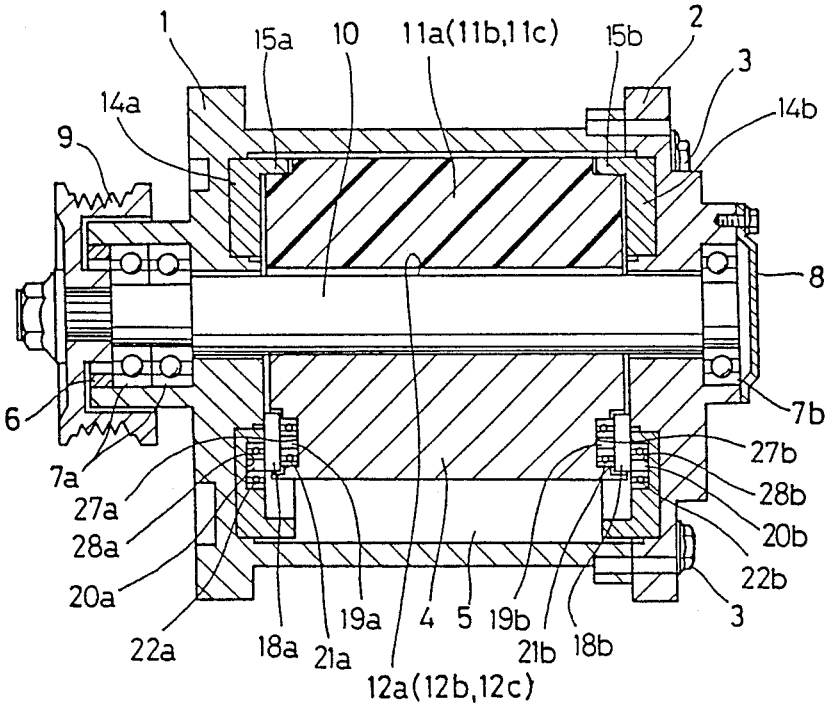
FIG. 42 is a sectional view of a vane pump according to still another embodiment of the present invention.
Figure 43:
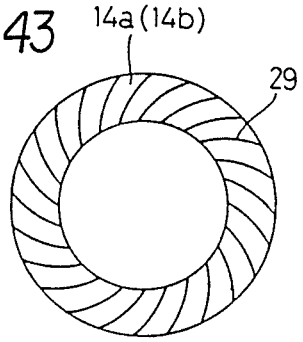
FIG. 43 is a front view of a retainer plate.

In the following, a third embodiment of the present invention will be described with reference to FIG. 42. In the pump according to the first embodiment, the retainer plates 14a and 14b have been supported by the bearings 16a and 16b. However, in the pump according to the third embodiment, the bearings 16a and 16b are removed. The pump of the third embodiment is characterized in that the retainer plates 14a and 14b are directly supported on the housings 1 and 2, and dynamic pressure bearing mechanisms are provided on the end surfaces or the peripheral surfaces of the retainer plates 14a and 14b to reduce the number of parts. This dynamic pressure bearing mechanism is composed of a groove capable of producing dynamic pressure such as a spiral groove, a Rayleigh step groove, a herringbone groove, etc. formed on the end surfaces or peripheral surfaces of the retainer plates 14a and 14b, or a recess or a combination of groove and recess to minimize the sliding resistance resulting from rotation of the retainer plates 14a and 14b. FIG. 43 shows, as one example of this dynamic pressure bearing mechanism, a spiral groove 29 provided in the outer end surface of the retainer plates 14a and 14b. Also in this pump, the cams 17a and 17b can be removed to simplify the construction.

Figure 44:
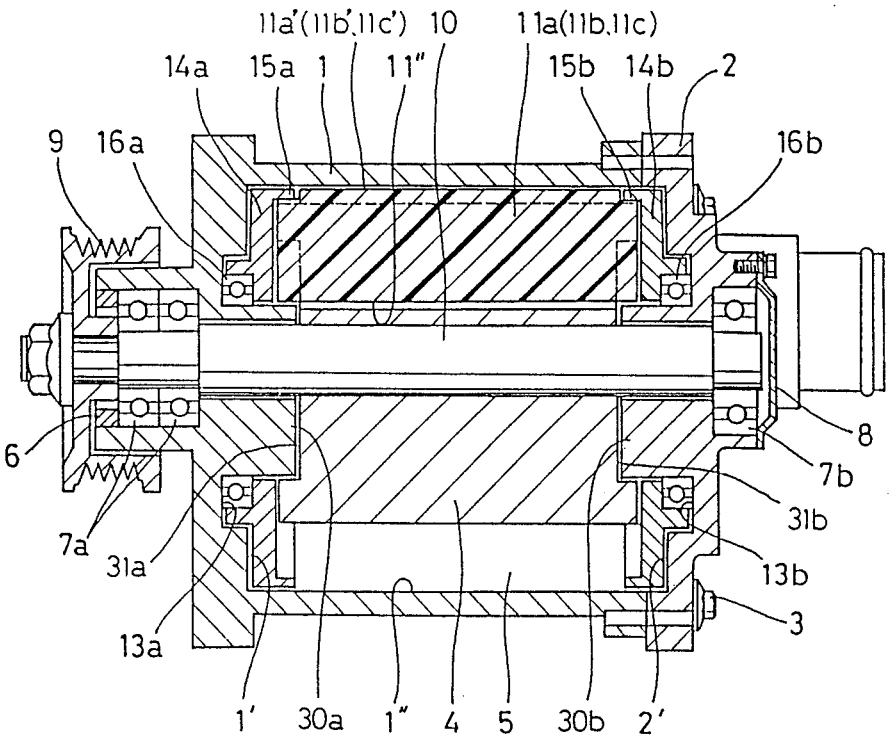
FIG. 44 is a sectional view of a vane pump according to yet another embodiment of the present invention.
Figure 45:
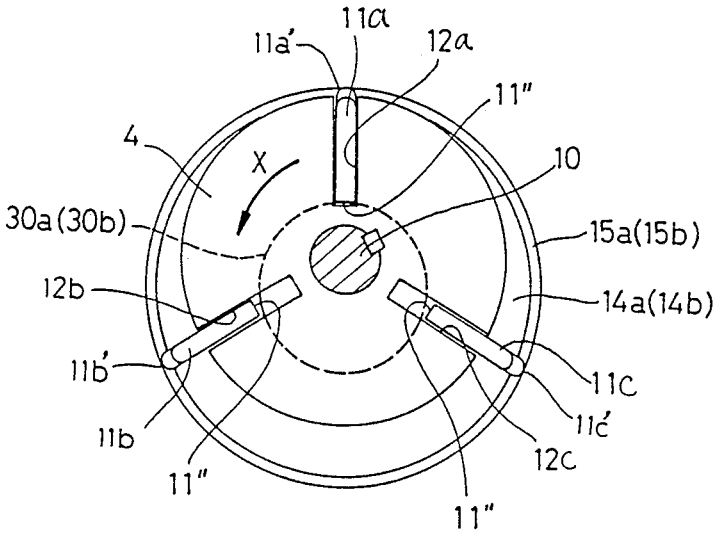
FIG. 45 is an explanatory view of an internal construction of the FIG. 44 pump as viewed axially.

Being common to the above-described respective embodiments, when the rotor 4 stops, some vanes 11a, 11b and 11c withdraw toward the bottom of the vane grooves 12a, 12b and 12c due to their own weight according to their angular position. With the aforesaid withdrawal the vanes 11a, 11b and 11c rapidly protrude at the time of start, and as the result the end edges 11a', 11b' and 11c' of the vanes impinge upon the stoppers 15a and 15b, thus resulting in a possible breakage of the vanes 11a, 11b and 11c and the stoppers 15a and 15b. To prevent this, the fourth embodiment of the present invention is characterized in that internally of both end walls of the housing, small-diameter bosses are projectingly provided coaxial with the inner peripheral surface of the housing to define the withdrawal of the vanes into the vane grooves. FIGS. 44 and 45 show an arrangement wherein such a construction is incorporated on the basis of the pump according to the first embodiment. More specifically, bosses 30a and 30b coaxial with the inner peripheral surface 1'' of the housing are projectingly provided on the internal surfaces 1' and 2' of the housings 1 and 2, and the bosses 30a and 30b are positioned in recesses 31a and 31b formed in both end surfaces of the rotor 4 so as to support the inner end edge 11' of the vanes 11a, 11b and 11c from the inner peripheral side. Thereby, when the rotor 4 stops, some of the vanes 11a, 11b and 11c tend to withdraw toward the bottom of the vane grooves 12a, 12b and 12c due to their own weight according to their angular position. However, the aforesaid withdrawal is defined by the impingement of the inner end edge 11'' of the vanes upon the outer peripheral surface of the bosses 30a and 30b. Thus, it is possible to avoid an excessive impact between the end edges 11a', 11b' and 11c' of the vanes and the stoppers 15a and 15b due to the rapid protrusion of the vanes 11a, 11b and 11c at the time of start.

As described above, according to the present embodiments, the hydrodynamic loss is overcome. In addition, since it is designed so that the vanes 8 rotate in non-contact with the inner peripheral surface 1'' of the housing 1, the loss caused by mechanical friction is also extremely reduced, and very high efficiency may be obtained.

Exemplification (III)

A further exemplication of a vane pump according to the present invention will be described hereinafter with reference to the embodiments shown in FIGS. 46 to 52.

Figure 46:
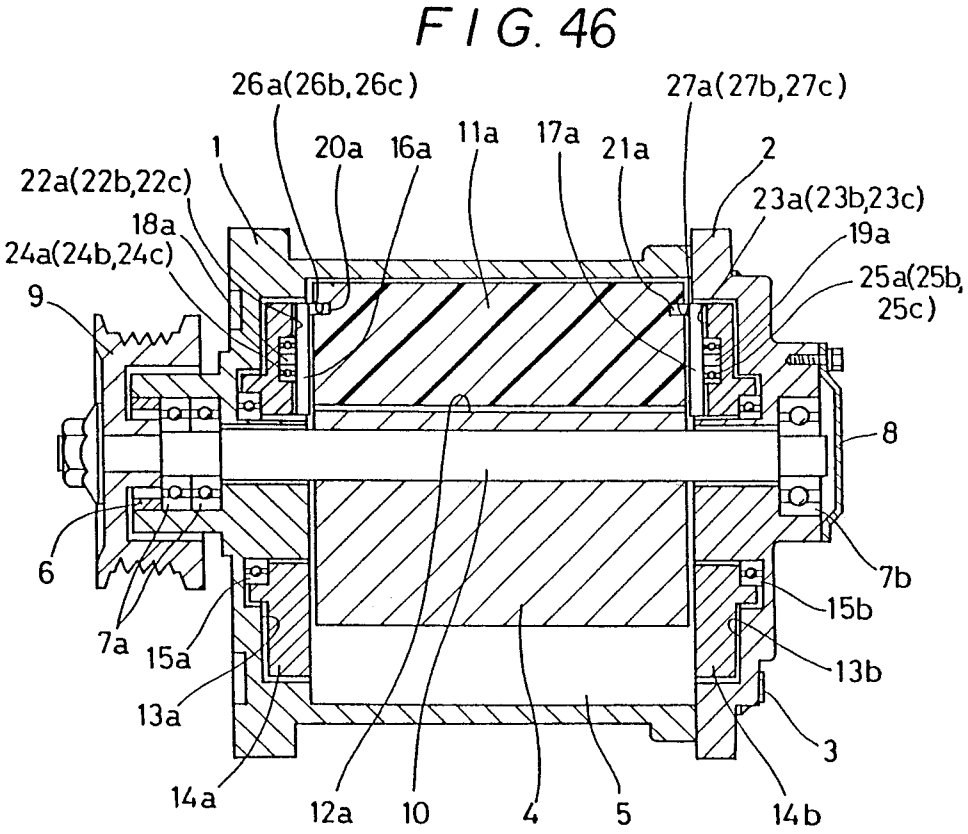
FIG. 46 is a sectional view of a vane pump according to another exemplification of the present invention.
Figure 47:
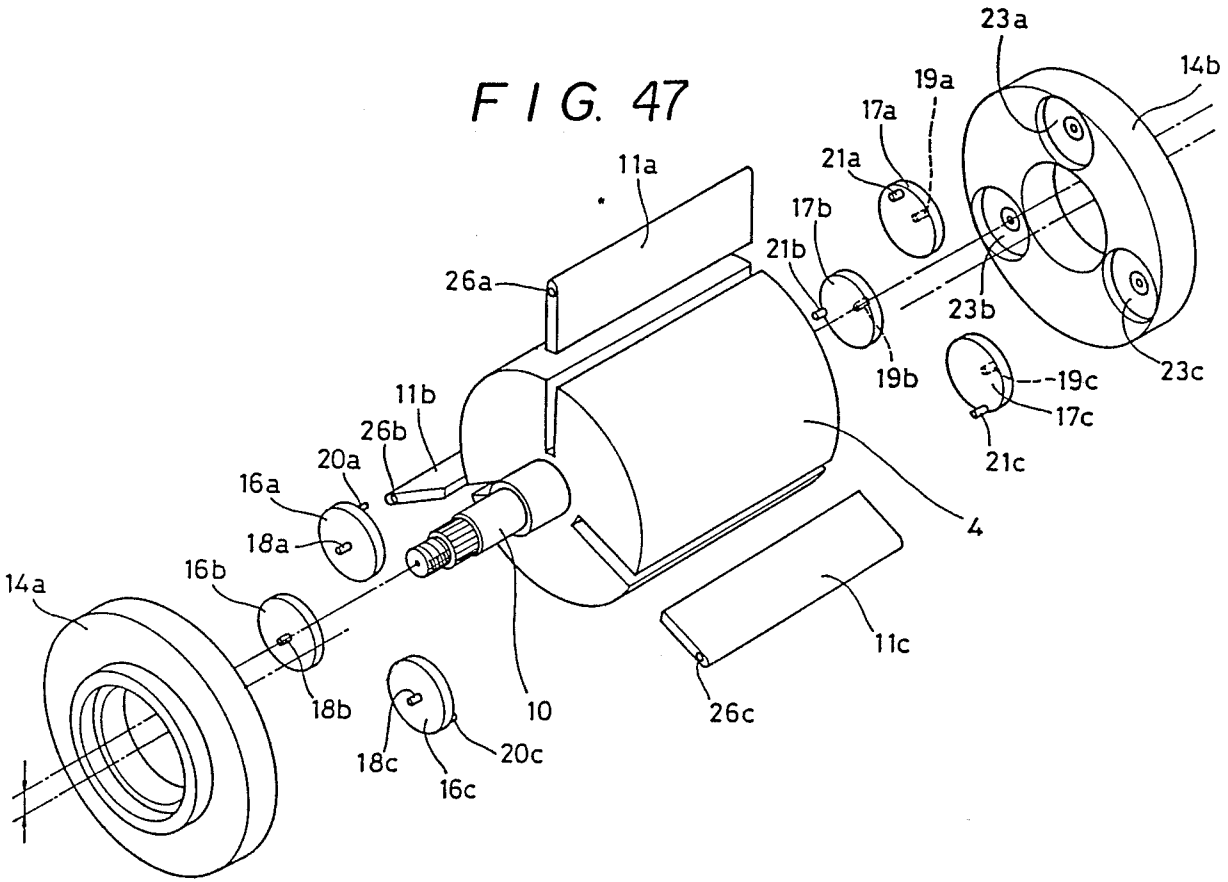
FIG. 47 is an exploded perspective view of an essential part of the FIG. 46 vane pump.
Figure 48:
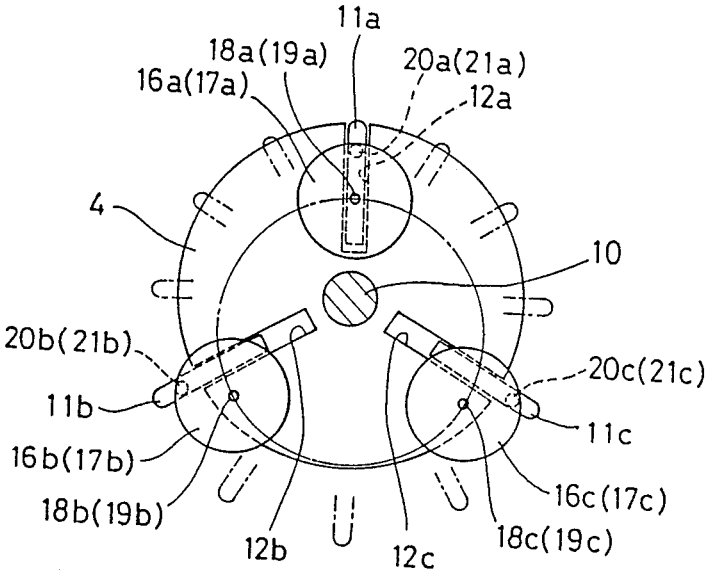
FIG. 48 is an explanatory view of the operation of the FIG. 46 vane pump.

In FIGS. 46 to 48 showing a first embodiment, a front housing 1 and a rear housing 2, which both housings are made of non-ferrous metal such as aluminum which is light in weight and is small in the coefficient of thermal expansion, are secured integral with each other by means of bolts. A rotor 4 made of iron eccentrically inserted into an inner peripheral space 5 of the housing is extended through both the housings 1 and 2 through a ball bearing 7a held by a fixed ring 6 in anti-slipout fashion in an axial shoulder of the front housing 1 and a ball bearing 7b held by a bearing cover 8 in anti-slipout fashion in an axial shoulder of the rear housing 2 and is rotatably mounted on a rotational shaft 10 to which a drive force is transmitted from a pulley 9. Plate-like vanes 11a, 11b and 11c principally made of a carbon material having an excellent slidability are disposed to be radially projected and retracted in vane grooves 12a, 12b and 12c, respectively, which are formed in the form of depressions equally spaced apart so as to peripherally divide the outer peripheral side of the rotor 4 into three sections, on the rotor 4. In annular recesses 13a and 13b formed in inner surfaces of end walls where the front housing 1 and rear housing 2 are opposed to each other coaxial with the inner peripheral space 5 of the housing (coaxial with an inner peripheral surface of the front housing 1), retainer plates 14a and 14b made of non-ferrous metal such as aluminum are rotatably fitted through ball bearings 15a and 15b, respectively. The vanes 11a, 11b and 11c are brought into engagement with the retainer plates 14a and 14b through cams 16a, 16b, 16c, 17a, 17b and 17c. The cams 16a, 16b, 16c, 17a, 17b and 17c fitted in recesses 22a, 22b, 22c, 23a, 23b and 23c equally spaced apart into three sections in the inner surface of the retainer plates 14a and 14b are rotatably provided on the retainer plates 14a and 14b through ball bearings 24a, 24b, 24c, 25a, 25b and 25c, with first pins 18a, 18b, 18c, 19a, 19b and 19c in engagement with the retainer plates 14a and 14b projected around one surface (outer surface) of a circular rotary plate, and are rotatably engaged with engaging recesses 26a, 26b, 26c, 27a, 27b and 27c in which second pins 20a, 20b, 20c, 21a, 21b and 21c are formed on the side ends of the vanes 11a, 11b and 11c, with second pins 20a, 20b, 20c, 21a, 21b and 21c in engagement with the vanes 11a, 11b and 11c projected in the vicinity of the peripheral edge of the other surface (inner surface) of the rotary plate. The engaging recesses 26a, 26b, 26c, 27a, 27b and 27c are provided close to the outer ends of the side ends of the vanes 11*a*, 11*b* and 11*c*. As shown in FIG. 48, at the top position in which the vane 11*a* is retracted most deeply within the vane groove 12*a*, the pins 18*a*, 19*a*, 20*a* and 21*a* of the cams 16*a* and 17*a* are laid on the vane 11*a*, and the second pins 20*a* and 21*a* are positioned close to the other ends of the first pins 18*a* and 19*a*.

The operation of the vane pump will be described hereinafter. When the rotational shaft 10 and the rotor 4 are rotated by the drive force from the pulley 9, the vanes 11*a*, 11*b* and 11*c* also rotate, and the torque is transmitted from the vanes 11*a*, 11*b* and 11*c* to the retainer plates 14*a* and 14*b* through the cams 16*a*, 16*b*, 16*c*, 17*a*, 17*b* and 17*c*. The retainer plates 14*a* and 14*b* rotate coaxially with respect to the peripheral surface of the housing, as a consequence of which the cams 16*a*, 16*b*, 16*c*, 17*a*, 17*b* and 17*c* fitted in the recesses 22*a*, 22*b*, 22*c*, 23*a*, 23*b* and 23*c* of the retainer plates 14*a* and 14*b* also rotate (revolve) coaxially with respect to the inner peripheral surface of the housing. Since the rotor 4 is rotatably mounted in eccentric relation with respect to the inner peripheral surface of the housing, as previously mentioned, the vane 11*a*and the cams 16*a* and 17*a* laid one above another at the top position are deviated with the rotation (but they are again laid one above another at the bottom position which is symmetrical with the top position through 180 degrees) at which the vane 11*a* is moved out of the vane grooves 12*a* farthest. With this arrangement, the vanes 11*a*, 11*b* and 11*c* connected to the retainer plates 14*a* and 14*b* through the cams 16*a*, 16*b*, 16*c*, 17*a*, 17*b* and 17*c* are radially slidably moved and repeatedly projected and retracted into the vane grooves 12*a*, 12*b* and 12*c* of the rotor 4 with the result that volumes of the working space defined by the housings 1, 2, the rotor 4 and the vanes 11*a*, 11*b* and 11*c* are repeatedly increased and decreased to transfer the fluid from the intake port not shown to the outlet port. In the above-described operation, the protrusion of the vanes 11*a*, 11*b* and 11*c* from the vane grooves 12*a*, 12*b* and 12*c* is defined, and the vanes are rotated not in contact with the inner peripheral surface of the housing, thereby eliminating the loss of torque and preventing wear and generation of heat.

Figure 49:
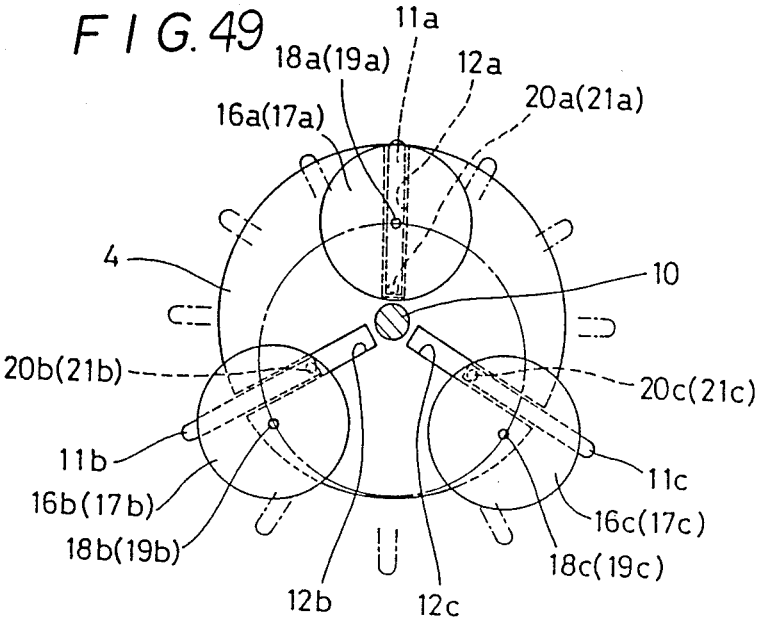
FIG. 49 is an explanatory view of the operation of a vane pump according to a further embodiment of the present invention.

FIG. 49 shows a second embodiment of the present invention in which second pins 20*a* and 21*a* of cams 16*a* and 17*a* superposed to vanes 11*a* at the top position are positioned toward the inner ends of first pins 18*a* and 19*a*, the engaging recesses 26*a*, 26*b*, 26*c*, 27*a*, 27*b* and 27*c* formed in the side ends of the vanes 11*a*, 11*b* and 11*c*, respectively, being provided toward the inner ends of these side ends. Other structures are the same as those of the aforementioned first embodiment, and the description thereof will be omitted with reference numerals merely affixed.

In the above-described both embodiments, the locus of the end edges of the vanes 11*a*, 11*b* and 11*c* whose protrusion is defined is not always circular, and it is therefore desired that in designing the pump, dimensions and arrangements of parts are adjusted so that the locus is made close to a circle. However, conversely, the inner peripheral surface of the housing is not made to be circular but adjusted to the locus so that the end edges of the vanes 11*a*, 11*b* and 11*c* and the clearance in the inner peripheral surface of the housing are maintained to be equal to each other over the whole periphery.

Figure 50:
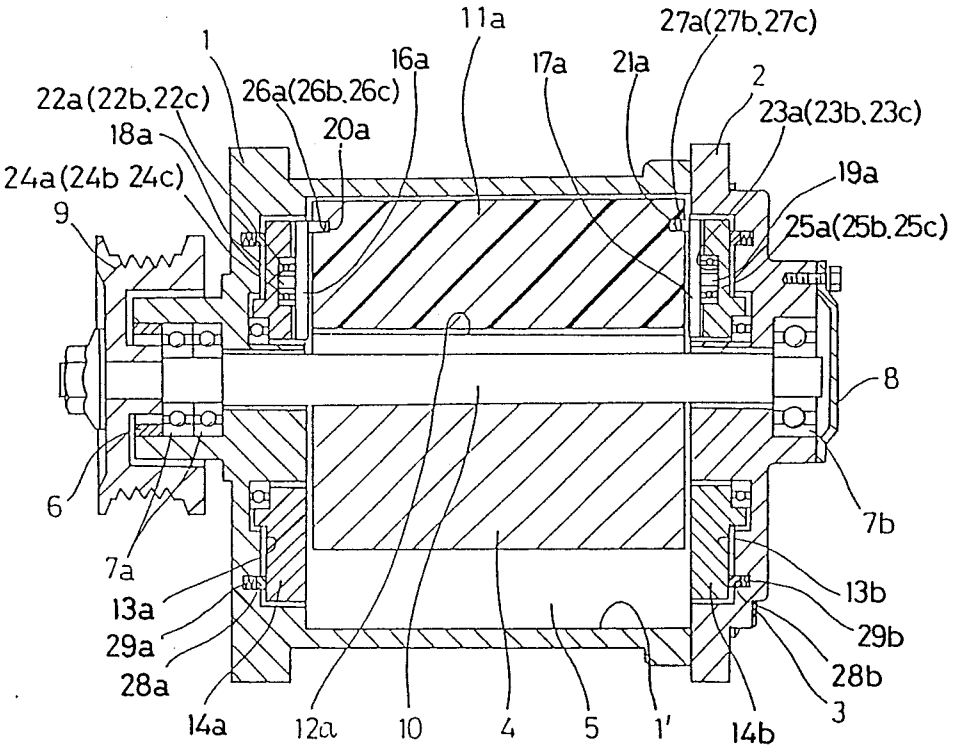
FIG. 50 is a sectional view of a vane pump according to yet another embodiment of the present invention.
Figure 51:
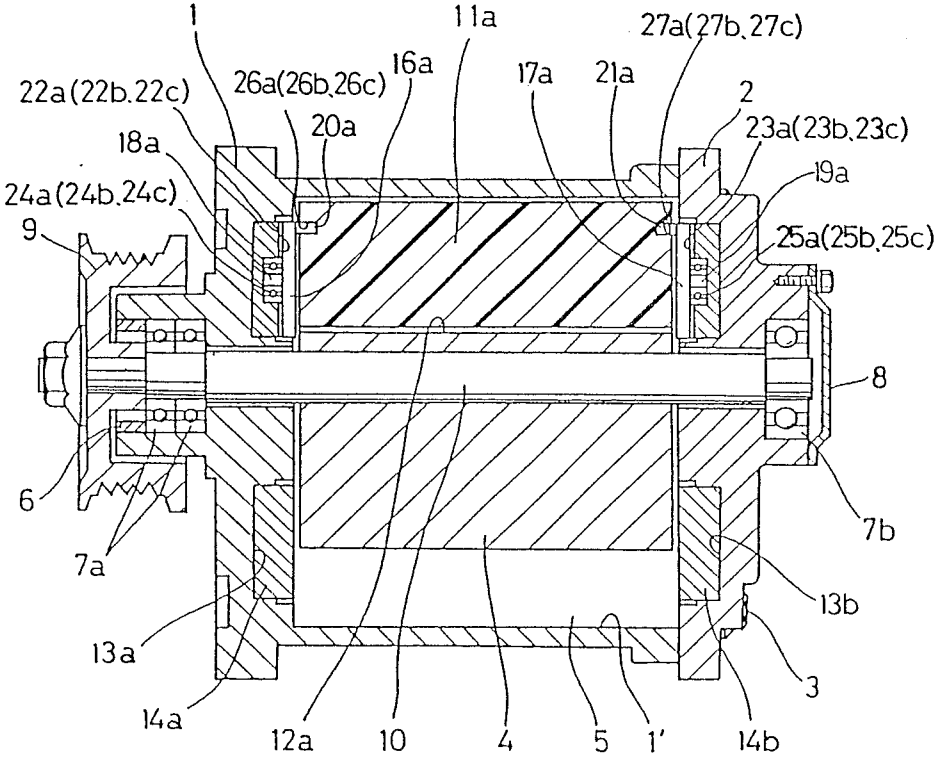
FIG. 51 is a sectional view of a vane pump according to still another embodiment of the present invention.

Next, a third embodiment of the present invention will be described with reference to FIG. 50. The third embodiment is, in addition to the features of the pump according to the first embodiment, characterized in that backup rings 28*a* and 28*b* for restraining a deflection of the retainer plates are interposed between the retainer plates and the end wall of the housing. The vanes 11*a*, 11*b* and 11*c* are supported on the retainer plates 14*a* and 14*b* through the cams 16*a*, 16*b*, 16*c*, 17*a*, 17*b* and 17*c*. To provide the smooth projection and retraction of the vanes 11*a*, 11*b* and 11*c*, the retainer plates 14*a* and 14*b* must be firmly supported and smoothly rotated in order not to oscillate the retainer plates 14*a* and 14*b*. Practically, however, the ball bearings 15*a* and 15*b* oscillate in the thrust direction, and the retainer plates 14*a* and 14*b* oscillate due to the pressure distribution within the working space 5 into contact with the end walls of the housings 1 and 2, resulting in a deviation or an inclination of the vanes 11*a*, 11*b* and 11*c*. The present pump takes this into consideration beforehand and the backup rings 28*a* and 28*b* are interposed between the retainer plates 14*a* and 14*b* and the end walls of the housings 1 and 2 to prevent the oscillation of the retainer plates 14*a* and 14*b*. The backup rings 28*a* and 28*b* made of non-lubrication sliding material such as carbon and resin are fitted in annular grooves positioned partly of the annular recesses 13*a* and 13*b*, and the ends thereof are brought into contact with the back of the retainer plates 14*a* and 14*b*. In addition, a number of coil springs 29*a* and 29*b* are provided as needed to strengthen the supporting force, thus preventing the oscillation of the retainer plates 14*a* and 14*b* to prevent the retainer plates 14*a* and 14*b* from contacting the end wall of the housing to indirectly secure the smooth operation of the vanes 11*a*, 11*b* and 11*c*.

When a dynamic pressure bearing such as a spiral groove, a herringbone groove, etc. is provided in the contact surface between the retainer plates 14*a*, 14*b* and the backup rings 28*a*, 28*b*, the sliding resistance may be reduced to make the rotation of the retainer plates 14*a* and 14*b* smooth.

Figure 52:
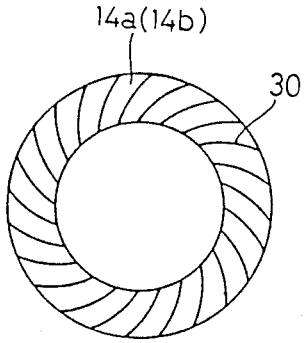
FIG. 52 is a front view of a retainer plate.

Next. a sixth embodiment of the present invention will be described hereinafter. According to the pump of this embodiment, while in the pump according to the first embodiment the retainer plates 14*a* and 14*b* are supported by the bearings 15*a* and 15*b*, this embodiment eliminates the need of the bearings 15*a* and 15*b*, and the retainer plates 14*a* and 14*b* are supported directly on the housings 1 and 2 and a dynamic pressure bearing mechanism is provided on the end or peripheral surface of the retainer plates 14*a* and 14*b* to reduce the number of parts, which constitutes the feature of this embodiment. This dynamic pressure bearing mechanism is composed of a groove capable of producing dynamic pressure such as a spiral groove, a Rayleigh step groove, a herringbone groove, etc. formed on the end surfaces or peripheral surfaces of the retainer plates 14*a* and 14*b*, or a recess or a combination of groove and recess to minimize the sliding resistance resulting from rotation of the retainer plates 14*a* and 14*b*. FIG. 52 shows, as one example of this dynamic pressure bearing mechanism, a spiral groove 30 provided in the outer end surface of the retainer plates 14*a* and 14*b*.

Exemplification (IV)

A further exemplification of a vane pump according to the present invention will be described hereinafter with reference to the embodiments shown in FIGS. 53 to 59.

Figure 53:
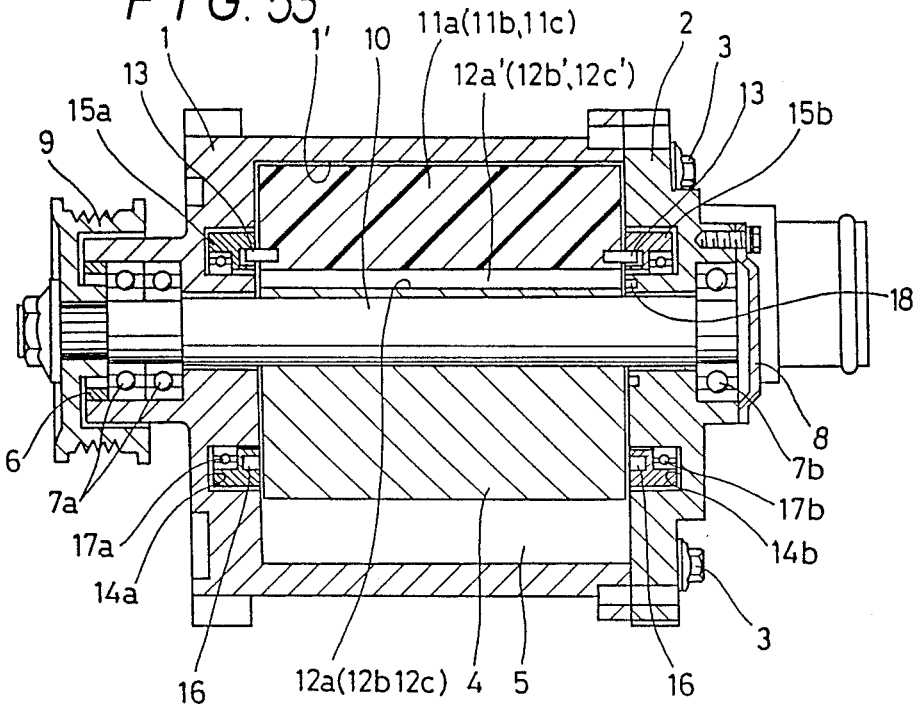
FIG. 53 is a sectional view of a vane pump according to another exemplification of the present invention.
Figure 54:
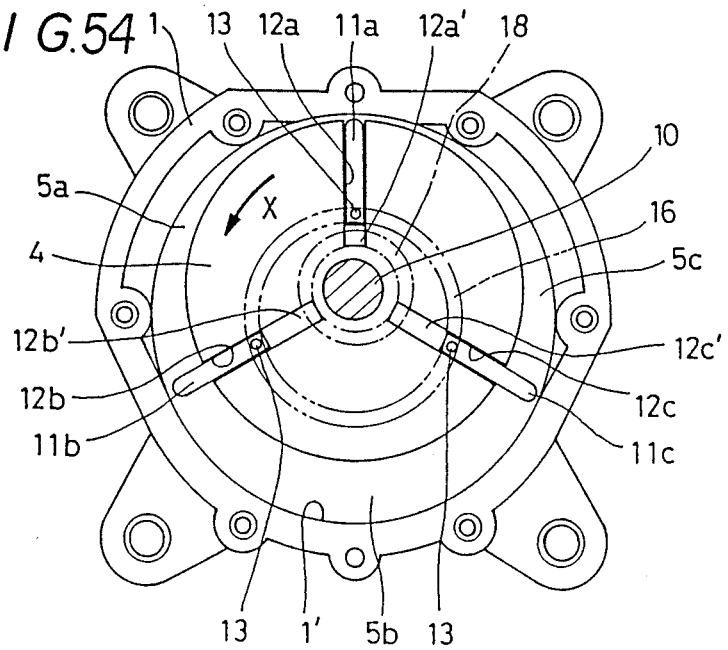
FIG. 54 is an explanatory view of the operation of the FIG. 53 embodiment.

In FIGS. 53 and 54 showing a first embodiment, a front housing 1 and a rear housing 2, which both housings are made of non-ferrous metal such as aluminum which is light in weight and is small in coefficient of thermal expansion, are secured integral with each other by means of bolts 3. A rotor 4 made of iron eccentrically inserted into an inner peripheral space 5 of the housing is extended through both the housings 1 and 2 through a ball bearing 7*a* held by a fixed ring 6 in anti-slipout fashion in an axial shoulder of the front housing 1 and a ball bearing 7*b* held by a bearing cover 8 in an anti-slipout fashion in an axial shoulder of the rear housing 2 and is rotatably mounted on a rotational shaft 10 to which a drive force is transmitted from a pulley 9. Plate-like vanes 11*a*, 11*b* and 11*c* principally made of a carbon material having an excellent slidability are disposed to be radially projected and retracted in vane grooves 12*a*, 12*b* and 12*c*, respectively, which are formed in the form of depressions equally spaced apart so as to peripherally divide the outer peripheral side of the rotor 4 into three sections, on the rotor 4. On opposite ends of each of the vanes 11*a*, 11*b* and 11*c* corresponding to axial opposite sides of the rotor 4 are projected steel pins 13 and 13, respectively, and a sleeve bearing made of resin having excellent slidability and abrasion resistance is slipped over each of pins 13. Rotatably fitted in annular recesses 14*a* and 14*a* formed in inner surfaces of end walls where the front housing 1 and the rear housing 2 are opposed to each other coaxial with the inner peripheral space 5 of the housing coaxial with an inner peripheral surface 1' of the front housing (1) are retainer plates 15*a* and 15*b* made of non-ferrous metal such as aluminum and each having an annular race 16. The pins 13 and 13 projected on the respective vanes 11*a*, 11*b* and 11*c* peripherally slidably engage the annular races 16 and 16 of the retainer plates 15*a* and 15*a*. This engagement defines the radial movement of the vanes 11*a*, 11*b* and 11*c* during rotation so as to maintain a state in which there is formed a slight clearance between the end edges thereof and the inner peripheral surface 1' of the front housing 1. In the inner surface of the end wall of the rear housing 2, an annular back pressure regulating groove 18 is formed coaxially wi(h the rotational shaft 10 on the inside diameter side of the annular recess 14*b* so that bottoms 12*a'*, 12*b* ' and 12*c* ' of vane grooves 12*a*, 12*b* and 12*c*, respectively, positioned in the back surface (inner end side) of the vanes 11*a*, 11*b* and 11*c* communicate with one another as shown in FIG. 54.

The operation of the above-described vane pump will be described hereinafter. When the rotational shaft 10 and rotor 4 are rotated by the drive force from the pulley 9, the vanes 11*a*, 11*b* and 11*c* also rotate, and the pins 13 and 13 projected on the vanes 11*a*, 11*b* and 11*c*, respectively, rotate along the annular races 17 and 17. Since as shown in FIG. 54 the inner peripheral surface 1' of the housing and the annular race 16 are in coaxial relation and the annular race 16 and the rotor are in eccentric relation, the vanes 11*a*, 11*b* and 11*c* are radially slidably moved in the vane grooves 12*a*, 12*b* and 12*c* of the rotor 4 to be projected and retracted repeatedly with the result that the volumes of the working spaces 5*a*, 5*b* and 5*c* defined by both the housings 1, 2, the rotor 4 and the vanes 11*a*, 11*b* and 11*c* repeatedly increase and decrease. That is, in FIG. 54, the working space 5*a*, with the rotation, increases its volume to suck the fluid from the intake port opening to portion 5*a*; the working space 5*c*, with the rotation, decreases its volume to discharge the fluid into the outlet port opening to portion 5*c*; and the working space 5*b* transfers the thus sucked fluid toward the outlet port. In the above-described operation, the end edges of the vanes 11*a*, 11*b* and 11*c* are not in sliding contact with the inner peripheral surface 1' of the front housing, as previously mentioned, and therefore, abrasion or high heat hardly occurs. The pins 13 are slidably rotated while being pressed against the outside diameter side by the centrifugal force within the annular race 16 of the retainer plates 15*a* and 15*b* but the retainer plates 15*a* and 15*b* follow the pins 13 and rotate since the retainer plates are in the state in which they may be rotated by the presence of the ball bearings 17*a* and 17*b*. The relative sliding speed between the pins 13 and the annular races 16 is small thereby minimizing the abrasions of the annular races (retainer plates 15*a*, 15*b*), pins 13, etc.

In the aforementioned operation, paying attention to the bottoms 12*a'*, 12*b* ' and 12*c* ' of the vane grooves 12*a*, 12*b* and 12*c*, the volumes of the bottoms 12*a'*, 12*b'* and 12*c'* are repeatedly increased and decreased by the projection and retraction of the vanes 11*a*, 11*b* and 11*c* caused by the rotation of the rotor 4, which is the minimum at the top position in which the vane 11*a* is in its most retracted state as shown in FIG. 54, whereas it is at the maximum at the bottom position in which the vane is in the most protruded state. The internal pressure of the bottoms 12*a'*, 12*b'* and 12*c'* acting as back pressure on the vanes 11*a*, 11*b* and 11*c* increases and decreases according to the aforesaid volumes to induce the state wherein a serious load is applied to the pin 13 in engagement with the annular race 16. More specifically, in FIG. 54, the vane groove bottom 12*b'* is in the process in which the volume thereof increases and the internal pressure of the bottom 12*b'* gradually decreases. The vane groove bottom 12*c'* which is in the position beyond the bottom position is conversely in the process in which the volume thereof decreases, and the internal pressure thereof gradually increases. Where the rotor 4 rotates at high speed, the repeated increase and decrease in the internal pressure applies a serious load to the pin 13 as back pressure with respect to the vanes 11*a*, 11*b* and 11*c*. In the worst case, the pin 13 becomes snapped.

Taking this into consideration, the present pump is provided with the back pressure regulating groove 18 so that the internal pressure of the vane groove bottoms 12*a'*, 12*b'* and 12*c'* may be regulated. The back pressure regulating groove 18 is annularly formed to be coaxial with the rotational shaft 10 in the inner surface of the end wall of the rear housing 2 as previously mentioned to communicate the vane groove bottoms 12*a'*, 12*b'* and 12*c'* with one another. That is, paying attention to the fact that a period of increase and decrease in volumes of the vane groove bottoms 12*a'*, 12*b'* and 12*c'* is deviated and the sum of the volumes of the three bottoms 12*a'*, 12*b'* and 12*c'* is always approximately equal, the back pressure regulating groove 18 transfers a part of the pressure from the bottom 12*c'* in the pressure increasing process to the bottom 12*b'* in the pressure decreasing process to always balance the aforesaid pressure so as not to induce an excessive increase or decrease in pressure to the bottoms 12*a'*, 12*b'* and 12*c'*.

Figure 55:
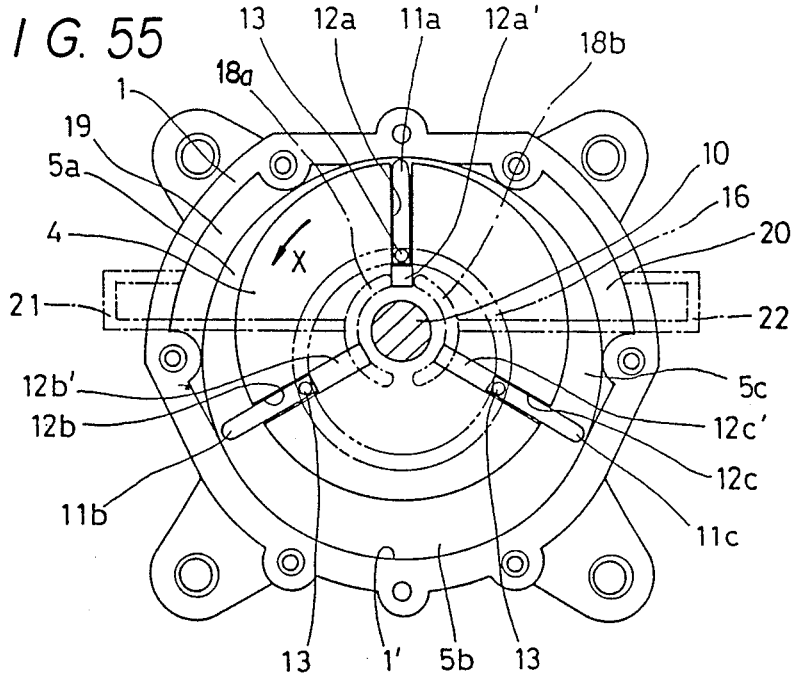
FIGS. 55 to 57 are respectively explanatory views showing different modes of a back pressure regulating groove.
Figure 56:
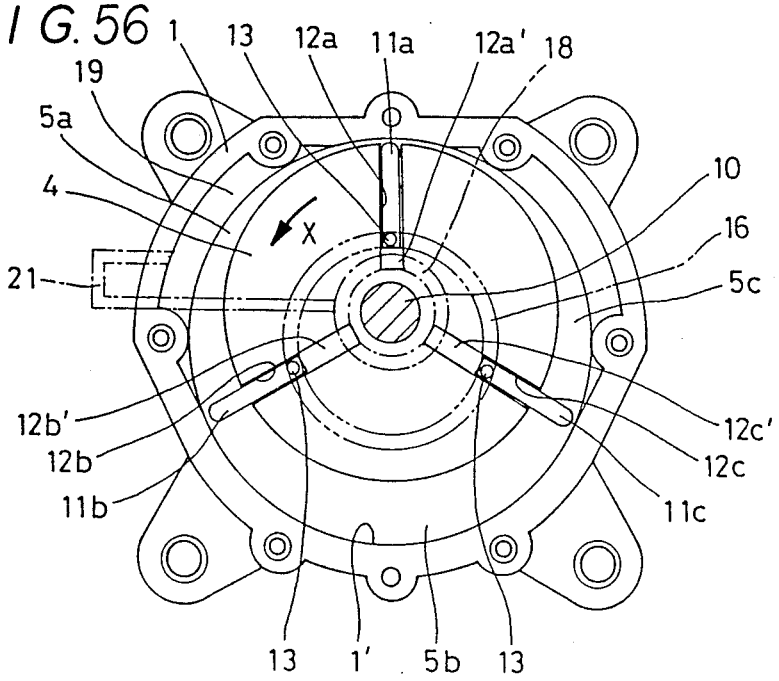
Figure 57:
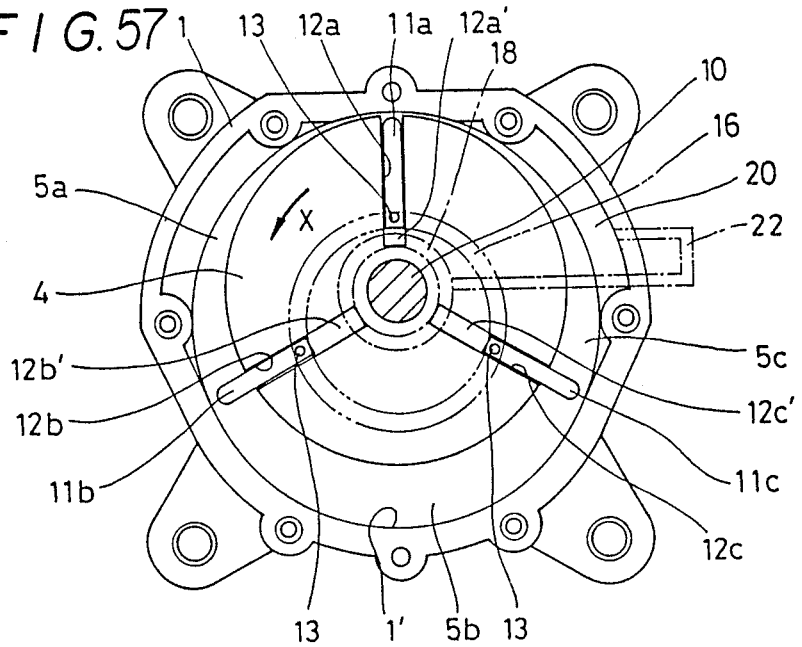

FIG. 55 shows an arrangement wherein the back pressure regulating groove 18 is divided into a pressure decreasing process portion 18*a* from the top position to the bottom position and a pressure increasing portion 18*b* from the bottom position to the top position. The former pressure decreasing process portion 18*a* and an inlet communication space 19, and the latter pressure increasing process portion 18*b* and an outlet communication space 20 are connected by pipes 21 and 22, respectively, whereby inside and outside of the vanes 11*a*, 11*b* and 11*c* (the vane groove bottoms and working spaces) are communicated to approximately balance the pressures between the inside and outside. FIG. 56 shows an arrangement wherein the annular back pressure regulating groove 18 and the inlet communication space 19 are connected through the pipe 21, and FIG. 57 shows an arrangement wherein the back pressure regulating groove 18 and the outlet communication space 20 are connected through the pipe 22, whereby the inside and outside of the vanes 11*a*, 11*b* and 11*c* are roughly equalized in pressure to relieve the load applied to the vanes.

Figure 58:
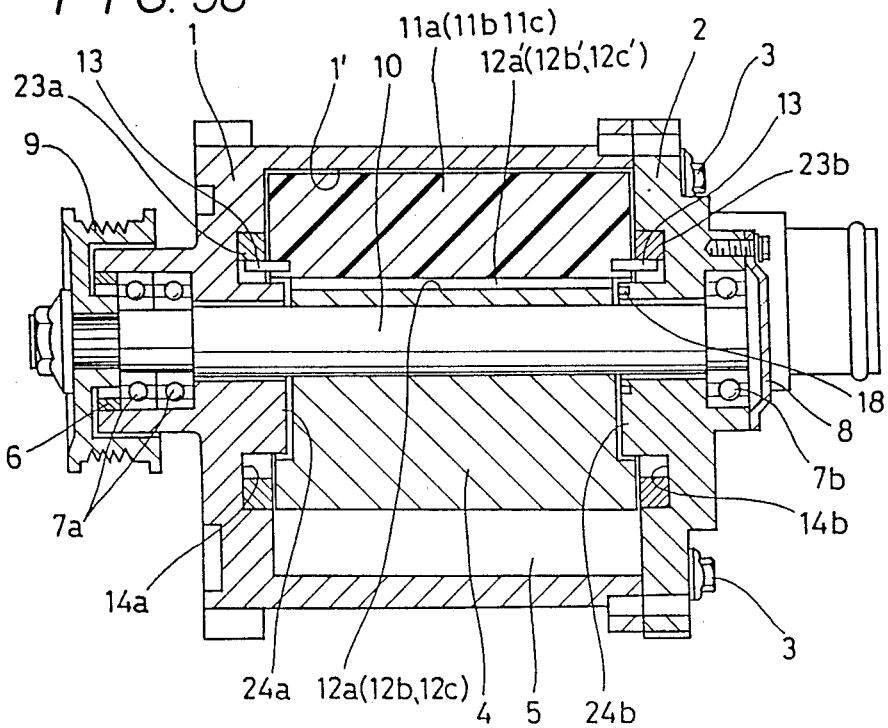
FIG. 58 is a sectional view of a vane pump according to a further embodiment of the present invention.

Next, a second embodiment of this aspect of the present invention will be described with regard to only parts different from those of the above-described first embodiment. As shown in FIG. 58, the vane pump is designed so that retainer rings 23*a* and 23*b* having a simple rectangular section in place of the retainer plates 15*a* and 15*b* having the annular race 16 in the first embodiment are fitted in annular recesses 14*a* and 14*b* in order to reduce trouble and cost required for manufacturing the retainer rings 23*a* and 23*b*. The pins 13 projected on the sides of the vanes 11*a*, 11*b* and 11*c* engage the inner peripheral surfaces of the retainer rings 23*a* and 23*b* to define the protrusion of the vanes from the vane grooves 12*a*, 12*b* and 12*c* and are maintained in non-contact with the inner peripheral surface 1' of the housing 1. With this arrangement, the vanes 11*a*, 11*b* and 11*c* are freed in a direction in which they are retracted into the vane grooves 12*a*, 12*b* and 12*c*, and the vanes 11*a*, 11*b* and 11*c* are freely retracted when the pump stops or runs at a low speed, by which movement the vanes undergo an impact load and are possibly damaged early. Therefore, bosses 24*a* and 24*b* as stoppers are projected internally of the vanes 11*a*, 11*b* and 11*c* to define the free movement thereof. These bosses 24*a* and 24*b* in the form of an annulus are provided coaxial with the inner peripheral space 5 of the housing 1 and molded integral with the end walls of the front housing 1 and rear housing 2. In the end surface of the boss 24*b* on the rear housing 2 side is formed back pressure regulating grooves 18, 18*a* and 18*b* having a construction as shown in the above-described figures. The retainer rings 23*a* and 23*b* may be replaced by ball bearings.

Figure 59:
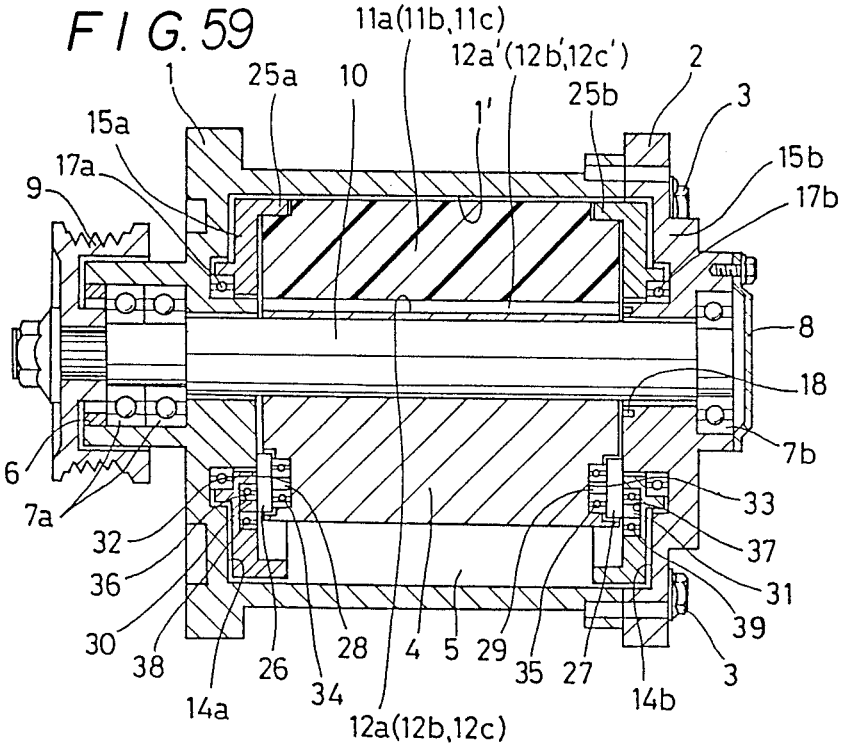
FIG. 59 is a sectional view of a vane pump according to still another embodiment of the present invention.

FIG. 59 shows a third embodiment of this aspect of the present invention. Stoppers 25*a* and 25*b* projected parallel to the axis are formed on the outer peripheral ends of retainer plates 15*a* and 15*b* to define the protrusion of the vanes 11*a*, 11*b* and 11*c*. Reference numerals 26 and 27 designate cams for rotatively connecting the rotor 4 and the retainer plates 15*a* and 15*b* between the opposite ends thereof, the cams being disposed three in number in equally spaced relation on one side of the rotor 4. The cams 26 and 27 fitted in recesses 32 and 33 formed in equally spaced relation on the end of the rotor 4 have first pins 28 and 29 extended to engage the rotor 4 at the center of one surface (inner surface) of a circular disk and are rotatably mounted on the rotor 4 through ball bearings 34 and 35. The cams further have second pins 30 and 31 extended to engage the retainer plates 15*a* and 15*b* in the vicinity of the peripheral edge of the other surface (outer surface) of the rotary disk and are rotatably engaged through ball bearings 38 and 39 with recesses 36 and 37 formed in the retainer plates 15*a* and 15*b*. The first pins 28 and 29 and the second pins 30 and 31 are on the circumferences of the same diameter eccentrically with each other through an eccentric amount of the rotor 4, and the retainer plates 15*a* and 15*b* are rotated in synchronism with the rotor 4 by the cams 26 and 27. This pump also defines the protrusion of the vanes 11*a*, 11*b* and 11*c* by the action of the stoppers 25*a* and 25*b* to maintain the vanes 11*a*, 11*b* and 11*c* not in contact with the housing 1. Further, the cams 26 and 27 are used to provide synchronous rotation between the rotor 4 and the retainer plates 15*a* and 15*b*, thus making it possible to suppress the loss of torque resulting from the rotation to prevent inconveniences such as wear, generation of heat and the like. It is to be noted that in the pump, the cams 26 and 27 may be removed to simplify the construction, and in addition, the boss described in connection with the above-described second embodiment may be added, and means for defining the movement of the vanes 11*a*, 11*b* and 11*c* may be used.

As means for defining the amount of protrusion of the vanes 11*a*, 11*b* and 11*c*, it is contemplated that in addition to the above, the aforesaid cams 26 and 27 are used to engage the vanes 11*a*, 11*b* and 11*c* with the retainer plates 15*a* and 15*b* for connection therebetween.

While we have described the preferred embodiment of the present invention, it will be obvious that various other modifications can be made without departing from the principle of the present invention. Accordingly, it is desired that all the modifications that may substantially obtain the effect of the present invention through the use of the structure substantially identical with or corresponding to the present invention are included in the scope of the present invention.

This application incorporates herein the disclosures of U.S. Ser. No. 075,006, filed July 17, 1987; U.S. Ser. No. 110,919 filed Oct. 21, 1987; U.S. Ser. No. 113,568 filed Oct. 26, 1987; and U.S. Ser. No. 115,677 filed Oct. 30, 1987, all abandoned.

What is claimed is:

1. A vane pump comprising a housing means having a rotor chamber, said rotor chamber having an inner annular surface, a rotor means rotatably mounted in said rotor chamber, said inner annular surface having a chamber axis which is eccentric relative to the axis of rotation of said rotor means, said rotor means having a plurality of generally radially disposed vane slots, a plurality of vane means slidably mounted in said vane slots and operable to define variable volume chambers for effecting a pumping action as said rotor means rotates and said vane means move generally radially in and out of said vane slots, said vane means having longitudinal ends, projection means projection from said longitudinal ends, said housing means having an annular channel coaxial with said chamber axis, said housing means having a housing portion disposed radially inwardly of said channel and having an outer peripheral surface defining an inner peripheral surface of said channel, said channel having an outer peripheral surface and a bottom surface, both formed by said housing means, said outer peripheral surface being spaced radially outwardly of said inner peripheral surface, annular ring means disposed in said channel, bearing means within said channel rotatably supporting said ring means within said channel, said ring means having inner and outer peripheral surfaces juxtaposed to the respective inner and outer peripheral surfaces of said channel, said ring means having a bottom surface juxtaposed to said bottom surface of said channel, with said chamber axis, annular ring means disposed in said channel, bearing means within said channel rotatably supporting said ring means within said channel, said ring means having an annular groove coaxial with said chamber axis, said groove having an inner cylindrical surface disposed to be engaged by said projection means such that during rotation of said rotor means, the resulting centrifugal force urges said vane means radially outwardly of the respective vane slot such that said projection means engages said inner cylindrical surface, said inner cylindrical surface being disposed to limit the extent of outward radial movement of said vane means from its respective vane slot to preclude sliding contact between said vane means and said inner annular surface of said housing means, said channel having inner and outer peripheral surfaces and a bottom surface, said ring means having inner and outer peripheral surfaces juxtaposed to the respective inner and outer peripheral surfaces of said channel, said ring means having an outer end surface juxtaposed to said rotor means and an inner end surface juxtaposed to said bottom surface of said channel, said ring means having an intermediate peripheral surface disposed radially intermediate said inner and outer peripheral surface of said ring means, said ring means having an intermediate transverse surface axially intermediate said outer and inner end surfaces, said bearing means being disposed between said intermediate peripheral surface of said ring means and said inner peripheral surface of said channel and between said intermediate transverse surface of said ring means and said bottom surface of said channel.

2. A vane pump according to claim 1, wherein said ring means has a cross-sectional configuration having an inner corner defined by one wall extending from said inner peripheral surface of said ring means and another wall extending from said bottom surface of said ring means, said bearing means being disposed on said inner corner between said other wall and said inner peripheral surface of said channel.

3. A vane pump according to claim 1, wherein said rotor chamber has longitudinal end walls perpendicular to said axis of rotation, said housing portion having an inner end wall which defines said rotor chamber end wall.

4. A vane pump according to claim 1, wherein said rotor means has a rotor shaft rotatably supported by said housing means, said housing means having an opening through which said rotor shaft extends, said opening being defined by a peripheral wall spaced radially inwardly of said inner peripheral surface of said channel, said housing portion being disposed in said space between said peripheral wall of said opening and said inner peripheral surface of said channel.

5. A vane pump according to claim 1, wherein said ring means is made of a non-ferrous material.

6. A vane pump comprising a housing means having a rotor chamber, said rotor chamber having an inner annular surface, a rotor means rotatably mounted in said rotor chamber, said inner annular surface having a chamber axis which is eccentric relative to the axis of rotation of said rotor means, said rotor means having a plurality of generally radially disposed vane slots, a plurality of vane means slidably mounted in said vane slots and operable to define variable volume chambers for effecting a pumping action as said rotor means rotates and said vane means move generally radially in and out of said vane slots, said vane means having longitudinal ends, projection means projecting from said longitudinal ends, said housing means having an annular channel coaxial said ring means having an annular groove coaxial with said chamber axis, said groove having an inner cylindrical surface disposed to be engaged by said projection means such that during rotation of said rotor means, the resulting centrifugal force urges said vane means radially outwardly of the respective vane slot such that said projection means engages said inner cylindrical surface, said inner cylindrical surface being disposed to limit the extend of outward radial movement of said vane means from its respective vane slot to preclude sliding contact between said vane means and said inner annular surface of said housing means.

7. A vane pump according to claim 6, wherein said vane means comprises a vane member having longitudinal ends, said projection means comprising pin means embedded in said vane member and extending from said longitudinal ends.

8. A vane pump according to claim 7, wherein said pin means comprises one pin extending from one longitudinal end of said vane member and another pin extending from the other longitudinal end of said vane member.

9. A vane pump according to claim 7, wherein said pin means is made of a non-ferrous metal and said vane member is made of non-metal.

10. A vane pump according to claim 7, wherein said pin means comprises a pin element and a sleeve bearing mounted on said pin element, said sleeve bearing being made of a resin material.

11. A vane pump according to claim 6, wherein said annular groove in said ring means has a bottom groove surface, said bottom groove surface being axially spaced from said bearing means.

12. A vane pump according to claim 11, wherein said bottom groove surface is axially spaced from said intermediate transverse surface of said ring means.

13. A vane pump according to claim 11, wherein said bottom groove surface, said outer and inner end surfaces of said ring means and said intermediate transverse surface of said ring means are disposed in spaced parallel relationship.

14. A vane pump according to claim 13, wherein said bottom groove surface, said outer and inner end surfaces of said ring means, and said intermediate transverse surface of said ring means are perpendicular to the axis of said rotor.

15. A vane pump according to claim 6, wherein said annular groove in said ring means has another inner cylindrical surface radially spaced from the first said inner cylindrical surface, said other inner cylindrical surface being spaced radially inwardly of said inner peripheral surface of said channel.

16. A vane pump according to claim 15, wherein said other inner cylindrical surface is spaced radially inwardly of said intermediate peripheral surface of said ring means.

17. A vane pump according to claim 6, wherein said inner cylindrical surface of said groove is disposed to provide a space between the outer radial ends of said vane means and said inner annular surface as said rotor motor means is rotated.

18. A vane pump according to claim 6, wherein said annular groove has a constant cross-sectional configuration to define a clear and uninterrupted annular groove.

19. A vane pump comprising a housing means having a rotor chamber, said rotor chamber having an inner annular surface, a rotor means rotatably mounted in said rotor chamber, said inner annular surface having a chamber axis which is eccentric relative to the axis of rotation of said rotor means, said rotor means having a plurality of generally radially disposed vane slots, a plurality of vane means slidably mounted in said vane slots and operable to define variable volume chambers for effecting a pumping action as said rotor means rotates and said vane means move generally radially in and out of said vane slots, said vane means having outer radial ends and longitudinal axial ends, projection means projecting from said longitudinal ends, said housing means having an annular channel co-axial with said chamber axis, said channel having inner and outer peripheral surfaces and a bottom surface, annular ring means disposed in said channel, said ring means having inner and outer peripheral surfaces juxtaposed to the respective inner and outer peripheral surfaces of said channel, said ring means having an outer end surface juxtaposed to said rotor and an inner end surface juxtaposed to said bottom surface of said channel, said ring means having an intermediate peripheral surface disposed radially intermediate said inner and outer peripheral surface of said ring means, said ring means having an intermediate transverse surface axially intermediate said outer and inner end surfaces, bearing means within said channel rotatably supporting said ring means within said channel, said bearing means being disposed between said intermediate peripheral surface of said ring means and said inner peripheral surface of said channel and between said intermediate transverse surface of said ring means and said bottom surface of said channel, said ring means further having an uninterrupted annular groove coaxial with said chamber axis, said groove having an inner cylindrical surface disposed to be engaged by said projection means such that during rotation of said rotor means, the resulting centrifugal force urges said vane means radially outwardly of the respective vane slot such that said projection means engages and presses against said inner cylindrical surface of said ring means to effect rotation of said ring means, said inner cylindrical surface being disposed to limit the extent of outward radial movement of said vane means from its respective vane slot to provide a space between said outer radial ends of said vane means and said inner annular surface of said rotor chamber, thereby precluding sliding contact between said outer radial ends of said vane means and said inner annular surface as said rotor means rotates within said housing means.

* * * * *